US010406582B2

(12) United States Patent
Nishimura et al.

(10) Patent No.: US 10,406,582 B2
(45) Date of Patent: Sep. 10, 2019

(54) PRESS-FORMING APPARATUS, METHOD FOR PRODUCING PRESS-FORMED PRODUCT USING THE FORMING APPARATUS, AND PRESS-FORMED PRODUCT

(71) Applicant: NIPPON STEEL & SUMITOMO METAL CORPORATION, Tokyo (JP)

(72) Inventors: Ryuichi Nishimura, Kimitsu (JP); Yoshiaki Nakazawa, Takarazuka (JP); Kenichiro Otsuka, Kisarazu (JP); Toru Yonebayashi, Tokai (JP); Ryuichi Harada, Higashiosaka (JP); Koji Hashimoto, Sodegaura (JP)

(73) Assignee: NIPPON STEEL CORPORATION, Tokyo (JP)

( * ) Notice: Subject to any disclaimer, the term of this patent is extended or adjusted under 35 U.S.C. 154(b) by 275 days.

(21) Appl. No.: 15/037,710

(22) PCT Filed: Dec. 2, 2014

(86) PCT No.: PCT/JP2014/006004
§ 371 (c)(1),
(2) Date: May 19, 2016

(87) PCT Pub. No.: WO2015/083367
PCT Pub. Date: Jun. 11, 2015

(65) Prior Publication Data

US 2016/0296989 A1 Oct. 13, 2016

(30) Foreign Application Priority Data

Dec. 6, 2013 (JP) ..... 2013-253148

(51) Int. Cl.
*B29C 47/76* (2006.01)
*B21D 22/26* (2006.01)
(Continued)

(52) U.S. Cl.
CPC ..... *B21D 22/26* (2013.01); *B21D 24/10* (2013.01); *B21D 53/88* (2013.01)

(58) Field of Classification Search
CPC ..... B21D 22/02; B21D 22/20; B21D 22/26; B21D 53/88; B30B 15/32; B29C 47/76
See application file for complete search history.

(56) References Cited

U.S. PATENT DOCUMENTS 7,971,466 B2 * 7/2011 Yoshitome ..... B21D 53/88 72/355.2
9,211,579 B2 * 12/2015 Tanaka ..... B21D 22/26
(Continued)

FOREIGN PATENT DOCUMENTS

JP 60-103518 7/1985
JP 64-066024 3/1989
(Continued)

*Primary Examiner* — Joseph S Del Sole
*Assistant Examiner* — Thu Khanh T Nguyen
(74) *Attorney, Agent, or Firm* — Clark & Brody

(57) ABSTRACT

A press-forming apparatus is an apparatus for producing a press-formed product having a hat-shaped cross section that has an external shape that curves in an L shape along a longitudinal direction in a planar view, and includes a punch, a first blank holder, a second blank holder, a preceding portion, a second die and a pad. When pushing the punch into a die to form a metal plate into the press-formed product, a first guide face of the preceding portion precedes a second guide face of the second die, and thereafter sliding of the first blank holder and the preceding portion relative to the punch is restricted and pushing of the punch into the die is continued in the restricted state to form the press-formed product. By this means, the press-formed product in which cracks and wrinkles are reduced is obtained.

4 Claims, 13 Drawing Sheets

(51) Int. Cl.
*B21D 24/10* (2006.01)
*B21D 53/88* (2006.01)

(56) References Cited

U.S. PATENT DOCUMENTS

| | | | | |
|---|---|---|---|---|
| 9,718,499 | B2 * | 8/2017 | Tanaka | B21D 53/88 |
| 9,839,951 | B2 * | 12/2017 | Nishimura | B21D 22/26 |
| 10,245,634 | B2 * | 4/2019 | Tanaka | B21D 22/26 |
| 10,265,752 | B2 * | 4/2019 | Otsuka | B21D 22/26 |
| 2003/0061852 | A1 * | 4/2003 | Yamano | B21D 5/01 72/306 |
| 2004/0094046 | A1 * | 5/2004 | Aoshima | B21D 24/02 100/218 |
| 2004/0244458 | A1 * | 12/2004 | Yamano | B21D 5/01 72/350 |
| 2005/0262917 | A1 * | 12/2005 | Osumi | B21D 5/00 72/379.2 |
| 2014/0182349 | A1 * | 7/2014 | Yonemura | B21D 22/26 72/349 |

FOREIGN PATENT DOCUMENTS

| | | |
|---|---|---|
| JP | 2982412 | 11/1999 |
| JP | 2009-255116 | 11/2009 |
| JP | 2012-157866 | 8/2012 |
| WO | 2011/145679 | 11/2011 |
| WO | 2013/094705 | 6/2013 |
| WO | 2014/106932 | 7/2014 |

* cited by examiner

PRESS-FORMING APPARATUS, METHOD FOR PRODUCING PRESS-FORMED PRODUCT USING THE FORMING APPARATUS, AND PRESS-FORMED PRODUCT

TECHNICAL FIELD

The present invention relates to a press-formed product having an external shape that curves in an L shape along a longitudinal direction in a planar view. More specifically, the present invention relates to a press-forming apparatus for producing a press-formed product having a cross-sectional form that is a hat shape, a method for producing a press-formed product using the forming apparatus, and a press-formed product.

BACKGROUND ART

The body of an automobile includes various structural members (for example, a front pillar lower outer reinforcement, a front pillar inner, a side sill outer reinforcement rear, a side sill inner and a rear side member). Press-formed products are frequently used as the structural members. In many cases, the cross-sectional form of a press-formed product that is used as a structural member is a hat shape or a groove shape.

FIGS. 1(*a*) and (*b*) are views that schematically illustrate an example of a press-formed product having a hat-shaped cross section. Among these figures, FIG. 1(*a*) shows a side view, and FIG. 1(*b*) shows a cross-sectional view along a line A-A in FIG. 1(*a*). As shown in FIG. 1(*b*), a press-formed product 90 includes a top plate portion 90*a*, vertical wall portions 90*b* and 90*c*, and flange portions 90*d* and 90*e*. The vertical wall portions 90*b* and 90*c* are connected to two side portions of the top plate portion 90*a*, respectively. The flange portions 90*d* and 90*e* are connected to the vertical wall portions 90*b* and 90*c*, respectively. The press-formed product 90 shown in FIGS. 1(*a*) and (*b*) extends linearly along the longitudinal direction in a planar view.

The above described type of press-fainted product having a hat-shaped cross section is formed by press working using a punch and die. At the time of press-forming, a blank holder is sometimes used to hold the edge of a metal plate (for example, a steel plate) that is a starting material. Press forming that uses a blank holder is also referred to as "drawing". Further, in press-forming (drawing), a pad is sometimes used together with a blank holder.

FIG. 2(*a*) to FIG. 2(*f*) are cross-sectional views that schematically illustrate working processes of conventional common press-forming (drawing). Among these figures, FIG. 2(*a*) illustrates a state before the start of forming FIG. 2(*b*) illustrates a state in which a blank metal plate is sandwiched by blank holders. FIG. 2(*c*) illustrates a state in which the blank metal plate is sandwiched using a pad. FIGS. 2(*d*) and (*e*) sequentially illustrate states during a process of pushing a punch into a die. FIG. 2(*f*) illustrates a state when forming is completed. The working processes illustrated in FIGS. 2(*a*) to (*f*) illustrate a case in which press working is performed on a blank metal plate 70 to form a press-formed product having a hat-shaped cross section. The press-formed product has a top plate portion, a vertical wall portion and a flange portion.

A press-forming apparatus 20 is equipped with an upper die 40 and a lower die 30. The upper die 40 includes a die 50 and a pad 41. The lower die 30 includes a punch 31, and blank holders 32 and 33 that are adjacent to two side portions of the punch 31, respectively.

The punch 31 has a die impression in which the shape of the press-formed product is reflected. In other words, as shown in FIG. 2(*a*), the punch 31 has an end face 31*a* that has a shape that corresponds to a top plate portion of the press-formed product. Further, the punch 31 has outer side faces 31*b* and 31*c* that have a shape that corresponds to a vertical wall portion of the press-formed product.

The die 50 has a die impression in which the shape of the press-formed product is reflected. In other words, the die 50 has guide faces 50*c* and 50*d* that have a shape that corresponds to a flange portion of the press-formed product, respectively. In addition, the die 50 has inner side faces 50*a* and 50*b* that have a shape that corresponds to a vertical wall portion of the press-formed product. The pad 41 constitutes one part of the die 50, and has an end face that has a shape that corresponds to the top plate portion of the press-formed product.

The pad 41 is mounted to the die 50 via a pad pressurizing mechanism (for example, a spring, rubber, a gas cylinder or a hydraulic cylinder) 42. By this means, the pad 41 is slidable in a pressing direction. Therefore the pad 41 is individually slidable with respect to the die 50. The end face of the pad 41 faces the end face 31*a* of the punch 31. Note that, in some cases the pad 41 is mounted to a die or a fixing jig or the like that is integrated with a ram (not illustrated in the drawings) of the press-forming apparatus and makes the same movement as the ram.

The blank holders 32 and 33 are slidably supported in a pressing direction by blank holder pressurizing mechanisms (for example, a spring, rubber, a hydraulic cylinder or a gas cylinder) 36 and 37, respectively. In this case, the term "pressing direction" refers to a direction in which the punch 31 and the die 50 relatively move at the time of press-forming. In the press-forming apparatus 20 illustrated in FIGS. 2(*a*) to (*f*), the vertical direction is the pressing direction.

The press-formed product having a hat-shaped cross section that is shown in FIG. 1 is produced by the following processes using the press-forming apparatus 20 configured as described above. As shown in FIG. 2(*a*), in a state in which the upper die 40 is withdrawn to the upper side, the blank metal plate 70 is placed on top of the lower die 30. In this state, the upper die 40 descends. Thereupon, as shown in FIG. 2(*b*), the guide faces 50*c* and 50*d* of the die 50 butt against the blank holders 32 and 33 via the blank metal plate 70, and the blank holder pressurizing mechanisms 36 and 37 move downward while imparting a restoring force in the upward direction. The blank holders 32 and 33 are pressed against the blank metal plate 70 by the restoring force of the blank holder pressurizing mechanisms 36 and 37. By this means, the blank metal plate 70 is sandwiched by the die 50 and the blank holders 32 and 33.

When the upper die 40 descends further, as shown in FIG. 2(*c*), the pad 41 butts against the punch 31 via the blank metal plate 70, and the pad pressurizing mechanism 42 contracts. The pad 41 is pressed against the blank metal plate 70 by the restoring force of the pad pressurizing mechanism 42. By this means, the blank metal plate 70 is sandwiched by the punch 31 and the pad 41.

In a state in which the blank metal plate 70 is sandwiched in this way, the upper die 40 descends further. Thereupon, as shown in FIGS. 2(*d*) and (*e*), the punch 31 and the die 50 move relatively, and the punch 31 is pushed into the die 50. As a result, both side portions in the width direction of the blank metal plate 70 move towards the center along the guide faces 50*c* and 50*d* of the die 50, and in accompaniment therewith one portion of the blank metal plate 70 is pushed into the die impression of the die 50.

Subsequently, as shown in FIG. 2(*f*), the upper die 40 arrives at bottom dead center. As a result, the top plate portion is finished by the end face 31*a* of the punch 31 and the pad 41, and the vertical wall portions are finished by the outer side faces 31*b* and 31*c* of the punch 31 and the inner side faces 50*a* and 50*b* of the die 50. Further, the flange portions are finished by the guide faces 50*c* and 50*d* of the die 50 and the blank holders 32 and 33. By performing press-forming in this manner, a press-formed product having a hat-shaped cross section is produced.

The following technology is available as prior art for forming a press-formed product having a hat-shaped cross section.

Japanese Patent Application Publication No. 2009-255116 (Patent Literature 1) discloses technology that uses a pad when performing press-forming by means of a punch and die. According to the technology disclosed in Patent Literature 1, a punch position, a die position and a pad position during press-forming are measured. Based on the measurement values, the position of the pad is controlled so that a relative displacement between the pad and the punch stays within a range of 10 to 20 mm until a relative displacement between the die and the pad from the start of forming becomes zero. By controlling the position of the pad in this way, slackness is formed in the blank metal plate between the punch and the pad, and the slackness that is formed is crushed out in a later stage of the press-forming. By this means, the technology described in Patent Literature 1 enlarges a bending region so that, as a result, spring back can be reduced.

International Application Publication No. WO2011/145679 (Patent Literature 2) discloses technology relating to a press-forming method that uses a die, a bending die and a pad. A press-formed product that is produced using the technology disclosed in Patent Literature 2 has an external shape that curves in an L shape along a longitudinal direction in a planar view. The press-formed product includes a top plate portion, vertical wall portions connected to the top plate portion, and flange portions connected to the vertical wall portions. Specifically, among two side portions of the top plate portion, a vertical wall portion is formed across an entire area at a side portion on a curved inner side. At a side portion on a curved outer side of the top plate portion, a vertical wall portion is formed only in an area from one edge until a position at which the side portion curves. In other words, the press-formed product described in Patent Literature 2 has an incomplete hat-shaped cross section in which a vertical wall portion is missing over a wide area on the curved outer side of the top plate portion.

According to the technology disclosed in Patent Literature 2, a blank metal plate is disposed between a die and pad and a bending die, and press-forming is performed in a state in which the pad is brought adjacent to or into contact with the blank metal plate. At such time, vertical wall portions and flange portions are formed while sliding at least one part of the blank metal plate over a region corresponding to the top plate portion among the entire region of the die. By this means, according to Patent Literature 2, a configuration is adopted that enables suppression of the occurrence of cracks in a flange portion and also enables suppression of the occurrence of wrinkles in a top plate portion in a curved region of a press-formed product.

CITATION LIST

Patent Literature

Patent Literature 1: Japanese Patent Application Publication No. 2009-255116

Patent Literature 2: International Application Publication No. WO2011/145679

SUMMARY OF INVENTION

Technical Problem

Vehicle body structural members (front pillar portion, side sill portion and the like) are constituted by individual press-formed products, or are constituted by joining a plurality of press-formed products by spot welding or the like. A lower end of a front pillar portion is joined to a front end of a side sill portion. In the front pillar portion, the portion thereof that is joined to the side sill portion is constituted by a front pillar lower outer reinforcement and a front pillar inner. A press-formed product having a hat-shaped cross section is used for the front pillar lower outer reinforcement. A press-formed product disclosed in the above described Patent Literature 2 may be mentioned as one example thereof.

Such a front pillar lower outer reinforcement is made in a shape that curves in an L shape along the longitudinal direction. This shape is adopted in order to improve performance such as vehicle body rigidity as well as collision safety performance.

FIGS. 3(*a*) and (*b*) are views that schematically illustrate a different example of a press-formed product having a hat-shaped cross section. Among these figures, FIG. 3(*a*) shows a plan view, and FIG. 3(*b*) shows a cross-sectional view along a line B-B in FIG. 3(*a*). The press-formed product shown in FIGS. 3(*a*) and (*b*) is applied to a front pillar lower outer reinforcement, and has an external shape that curves in an L shape along the longitudinal direction in a planar view, and has a hat-shaped cross section across the entire area in the longitudinal direction. Hereunder, a press-formed product of this shape is also referred to as a "specific press-formed product". Note that, in FIGS. 3(*a*) and (*b*), to facilitate the description, a press-formed product that is used as a front pillar lower outer reinforcement is illustrated as an example, a lower end side thereof that is joined to a side sill portion is referred to as "back" in the longitudinal direction (see reference character "B" surrounded by a circle in FIG. 3(*a*)), and a top end side that is opposite to the "back" is referred to as "front" in the longitudinal direction (see reference character "F" surrounded by a circle in FIG. 3(*a*)).

As shown in FIG. 3(*b*), the press-formed product 10 includes a top plate portion 10*a*, a first vertical wall portion 10*b*, a second vertical wall portion 10*c*, a first flange portion 10*d* and a second flange portion 10*e*. The top plate portion 10*a* has an L-shaped curved region. The first vertical wall portion 10*b* is connected to the entire area of a side portion on the curved inner side among two side portions of the top plate portion 10*a*. The second vertical wall portion 10*c* is connected to the entire area of a side portion on the curved outer side among the two side portions of the top plate portion 10*a*. The first flange portion 10*d* is connected to the first vertical wall portion 10*b*. The second flange portion 10*e* is connected to the second vertical wall portion 10*c*.

As shown in FIGS. 3(*a*) and (*b*), a boundary portion 10*f* between the top plate portion 10*a* and the first vertical wall portion 10*b* has a substantially quarter arc-shaped region 10*j*

(hereunder, also referred to as "first arc-shaped region of the top plate portion") that curves along a curved region of the top plate portion 10*a* (see thick line in FIG. 3(*a*)). Further, a boundary portion 10*g* between the top plate portion 10*a* and the second vertical wall portion 10*c* also has a substantially quarter arc-shaped region 10*k* (hereunder, also referred to as "second arc-shaped region of the top plate portion") that curves along a curved region of the top plate portion 10*a* (see thick line in FIG. 3(*a*)).

The specific press-formed product 10 can be produced by press-forming using a punch, a die and a blank holder. However, when using a high-strength metal plate, for example, a metal plate having a tensile strength (TS) of 590 MPa or more, as a blank metal plate, cracks or wrinkles are liable to occur in the press-formed product 10.

On the other hand, even in the case of using a metal plate having a tensile strength (TS) of less than 590 MPa as a blank metal plate, if a depth d1 of the first vertical wall portion 10*b* or a depth d2 of the second vertical wall portion 10*c* is deep, cracks or wrinkles are liable to occur in the press-formed product 10. Further, cracks or wrinkles are also liable to occur in the press-formed product 10 in a case where the radius of curvature of the first arc-shaped region 10*j* of the top plate portion is small or a case where the radius of curvature of the second arc-shaped region 10*k* of the top plate portion is small.

FIGS. 4(*a*) to (*c*) are views that illustrate the distribution of a plate thickness decrease rate when the specific press-formed product is produced by press-forming. Among these figures, FIG. 4(*a*) illustrates a case where the specific press-formed product shown in the above described FIG. 3 is produced by drawing using a punch, a die and a blank holder. FIG. 4(*b*) illustrates a case where a specific press-formed product having a shape in which one end in the longitudinal direction is closed is produced by the same drawing as that used in the case illustrated in FIG. 4(*a*). FIG. 4(*c*) illustrates a case where the specific press-formed product shown in the above described FIG. 3 is produced by drawing using a pad in addition to a punch, a die and a blank holder. In FIGS. 4(*a*) to (*c*), the plate thickness decrease rates are indicated by degrees of shading, and the contour shape of the blank metal plate 70 before press-forming is shown by a solid line. The plate thickness decrease rate is a rate of decrease (%) in the plate thickness based on the thickness of the blank metal plate 70.

The plate thickness decrease rate was determined by FEM analysis. At that time, a 980 MPa-class dual-phase, high strength steel plate having a plate thickness of 1.6 mm was used as the blank metal plate. The dimensions and shape of the press-formed product were the same as in examples that are described later. The plate thickness decrease rate rtb (%) was calculated by the following Formula (1).

$$rtb=(tb-t)/tb\times 100 \quad (1)$$

In the above Formula (1), tb represents the plate thickness (mm) of the blank metal plate, and t represents the plate thickness (mm) of the press-formed product.

As shown in FIG. 4(*a*), in the case where the specific press-formed product was produced by drawing using a punch, a die and a blank holder, a noticeable thickness reduction occurred in an X region of the curved inner side of the second arc-shaped region of the top plate portion. In this case, because of the characteristics of the material adopted for the blank metal plate, if the plate thickness decrease rate is more than around 18%, cracks are generated in the actual formed product that is obtained by the press-forming. Therefore, in the specific press-formed product shown in FIG. 4(*a*), cracks are generated in the X region. Note that, the X region includes the second arc-shaped region of the top plate portion that adjoins the X region as well as the vicinity of this arc-shaped region.

Further, in the case of the specific press-formed product shown in FIG. 4(*a*), in a Y region on the curved outer side of the first arc-shaped region of the top plate portion, the plate thickness decrease rate repeatedly increases and decreases at a short cycle along the longitudinal direction. This means that wrinkles are generated in the actual formed product that is obtained by the press-forming. Therefore, in the specific press-formed product shown in FIG. 4(*a*), wrinkles are generated in the Y region. Note that, the Y region includes the first arc-shaped region of the top plate portion adjoining the Y region as well as the vicinity of this arc-shaped region.

As shown in FIG. 4(*b*), in a case where the specific press-formed product having a shape in which one end in the longitudinal direction is closed was produced by drawing performed in the same manner as in the case of the specific press-formed product illustrated in FIG. 4(*a*), a thickness reduction occurred in the same X region as in FIG. 4(*a*). However, because the amount of the thickness reduction decreased relative to the specific press-formed product illustrated in FIG. 4(*a*), the occurrence of cracks is reduced. Further, in the specific press-formed product shown in FIG. 4(*b*), wrinkles are generated in the same Y region as in FIG. 4(*a*). Note that, because the specific press-formed product shown in FIG. 4(*b*) has a shape in which the first vertical wall portion and the second vertical wall portion are connected at the rear end in the longitudinal direction, the shapes of the punch, the die and the blank metal plate were changed to match to this shape.

As shown in FIG. 4(*c*), in a case where the specific press-formed product was produced by drawing performed using a pad in addition to a punch, a die and a blank holder, a noticeable thickness reduction occurred in the same X region as in FIG. 4(*a*). Therefore, cracks are generated in the X region. Further, in the specific press-formed product shown in FIG. 4(*c*), the occurrence of wrinkles is suppressed in the Y region.

In the specific press-formed products shown in FIGS. 4(*a*) to (*c*), a large amount of excess metal is provided in a Z region (see the above described FIG. 3(*a*)) of the first flange portion on the curved inner side that corresponds to the curved region of the top plate portion. This excess metal is obtained by expanding the width of the blank metal plate. In a case where this excess metal is not provided, as shown in the above described FIG. 3(*a*), cracks are liable to arise in the Z region. The Z region includes an arc-shaped region (hereunder also referred to as "first arc-shaped region of the flange portion") that adjoins the Z region among the entire area of the boundary portion between the first flange portion and the first vertical wall portion, as well as the vicinity of this arc-shaped region.

As a method for suppressing the occurrence of such cracks or wrinkles, it is conceivable to apply the technology disclosed in the aforementioned Patent Literature 1 to drawing of the specific press-formed product. In this case, since a pad is used in press-forming by a punch and die, it is possible to reduce wrinkles in the Y region to some extent. However, on the other hand, wrinkles will arise in a W region (see the above described FIG. 3(*a*)) in the second flange portion on the curved outer side that corresponds to the curved region of the top plate portion. The W region includes an arc-shaped region (hereunder also referred to as "second arc-shaped region of the flange portion") that adjoins the W region among the entire area of the boundary portion between the second flange portion and the second vertical wall portion, as well as the vicinity of this arc-shaped region.

Further, a press-formed product that is adopted as an object of production with the technology disclosed in the aforementioned Patent Literature 2 is a press-formed product having an incomplete hat-shaped cross section in which a vertical wall portion is missing over a wide range. Consequently, it is difficult to apply the technology disclosed in Patent Literature 2 to drawing of the specific press-formed product. If, for instance, the technology disclosed in Patent Literature 2 were applied to drawing of the specific press-formed product, wrinkles would arise in the W region (see the aforementioned FIG. 3(*a*)) of the second flange portion.

The present invention has been conceived in consideration of the actual circumstances that are described above. An objective of the present invention is to provide a press-forming apparatus having a characteristic described hereunder with regard to a press-formed product that has an external shape that curves in an L shape along a longitudinal direction in a planar view and also has a hat-shaped cross section across approximately an entire area in the longitudinal direction, a method for producing a press-formed product using the forming apparatus, and a press-formed product:

obtainment of a press-formed product in which cracks and wrinkles are reduced.

Solution to Problem

A press-forming apparatus according to one embodiment of the present invention is a press-forming apparatus for producing a press-formed product having an external shape that curves in an L shape along a longitudinal direction in a planar view.

The press-formed product includes:

a top plate portion including an L-shaped curved region;

a first vertical wall portion that is connected to a side portion on a curved inner side among two side portions of the top plate portion;

a second vertical wall portion that is connected to a side portion on a curved outer side among the two side portions of the top plate portion;

a first flange portion that is connected to the first vertical wall portion; and a second flange portion that is connected to the second vertical wall portion.

The press-forming apparatus includes a punch, a first blank holder, a second blank holder, a die, a pad, a preceding portion and a restriction mechanism.

The punch has an end face, a first outer side face and a second outer side face that have shapes that correspond to the top plate portion, the first vertical wall portion and the second vertical wall portion, respectively.

The first blank holder is adjacent to a curved inner side of the punch, and is slidable in a pressing direction.

The second blank holder is adjacent to a curved outer side of the punch, and is slidable in the pressing direction.

The die forms a pair with the punch, the first blank holder, and the second blank holder, and includes a first inner side face and a second inner side face that have shapes that correspond to the first vertical wall portion and the second vertical wall portion, respectively, and a first guide face and a second guide face that face the first blank holder and the second blank holder, respectively.

The pad constitutes one part of the die and is slidable in the pressing direction, and among an entire region of the end face of the punch, faces at least a region that corresponds to the curved region of the top plate portion.

The preceding portion constitutes one part of the die and is slidable in the pressing direction, and among an entire region of the first guide face and the first inner side face, includes at least a region that corresponds to the curved region of the top plate portion.

Operations of the press-forming apparatus are as described below.

When pushing the punch into the die by relatively moving the punch and the die in the pressing direction to form a metal plate into the press-formed product, the first guide face of the preceding portion precedes the second guide face of the die, and the first vertical wall portion and the first flange portion are formed. Thereafter, sliding of the first blank holder and the preceding portion relative to the punch is restricted by the restriction mechanism, and pushing of the punch into the die is continued in the restricted state and the second vertical wall portion and the second flange portion are formed.

The above described press-forming apparatus can have a configuration that further includes a cushion and a stopper.

The cushion slidably supports the first blank holder in the pressing direction via a cushion pin.

The stopper limits sliding of the first blank holder.

In the case of this configuration, by separating the cushion pin and the first blank holder while limiting sliding of the first blank holder with the stopper, the restriction mechanism restricts sliding of the first blank holder, and restricts sliding of the preceding portion following restriction of the first blank holder.

The above described press-forming apparatus can adopt a configuration that further includes a pressurizing mechanism instead of the above described configuration.

The pressurizing mechanism slidably supports the first blank holder in the pressing direction.

In the case of this configuration, the restriction mechanism restricts the first blank holder by limiting sliding of the first blank holder, and restricts sliding of the preceding portion following restriction of the first blank holder.

A method for producing a press-formed product according to one embodiment of the present invention is a method that, when producing the above described press-formed product from a metal plate by press-forming, executes formation of the first vertical wall portion and the first flange portion prior to formation of the second vertical wall portion and the second flange portion.

The described production method can adopt the following configuration.

The method for producing the press-formed product uses the above described press-forming apparatus, and includes a holding process and a forming process.

In the holding process, in a state in which the first guide face of the preceding portion precedes the second guide face of the die, the metal plate is sandwiched by the first blank holder, the second blank holder and the pad.

In the forming process, by relatively moving the punch and the die in the pressing direction, the punch is pushed into the die to form the metal plate into the press-formed product.

The forming process includes a first step and a second step.

In the first step, in a state in which the first guide face of the preceding portion precedes the second guide face of the die, pushing of the punch into the die is performed to form the first vertical wall portion and the first flange portion.

In the second step, sliding of the first blank holder and the preceding portion relative to the punch is restricted by the restriction mechanism, and pushing of the punch into the die is continued in the restricted state to form the second vertical wall portion and the second flange portion.

A press-formed product according to one embodiment of the present invention has an external shape that curves in an L shape along a longitudinal direction in a planar view.

The press-formed product includes:

a top plate portion including an L-shaped curved region;

a first vertical wall portion that is connected to a side portion of a curved inner side among two side portions of the top plate portion;

a second vertical wall portion that is connected to a side portion of a curved outer side among the two side portions of the top plate portion;

a first flange portion that is connected to the first vertical wall portion; and a second flange portion that is connected to the second vertical wall portion;

wherein, a tensile strength thereof is 590 MPa or more.

Advantageous Effect of Invention

A press-forming apparatus, a method for producing a press-formed product using the forming apparatus, and a press-formed product of the present invention have the following remarkable advantageous effect:

obtainment of a press-formed product in which cracks and wrinkles are reduced.

DESCRIPTION OF EMBODIMENTS

Figure 5:
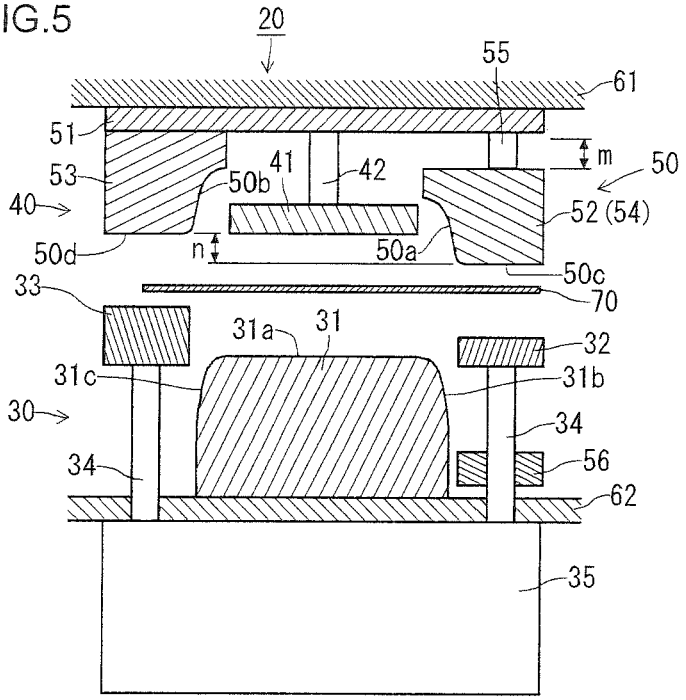
FIG. 5 is a cross-sectional view that schematically illustrates a press-forming apparatus of a first embodiment of the present invention.

To achieve the above described objective, the present inventors preformed various experiments and conducted concentrated studies. As a result, as shown in FIG. 5 that is described later, the present inventors discovered that when press-forming (drawing) using blank holders 32 and 33 together with the pad 41, it is advantageous for the guide face (first guide face) 50*c* on the curved inner side of the die to precede the guide face (second guide face) 50*d* on the curved outer side thereof. In this case, a curved inner side of a curved region of the top plate portion, more specifically, the first vertical wall portion and the first flange portion, are finished prior to other portions. As a result, the blank metal plate leans to the curved inner side. Consequently, compared to a case where the first guide face 50*c* does not precede, a state is entered in which there is a surplus of the blank metal plate in the vicinity of the second arc-shaped region 10*k* of the top plate portion. In this state, the curved outer side of the curved region of the top plate portion, more specifically, the second vertical wall portion and the second flange portion are finished. By this means, a thickness reduction in the X region of the curved inner side of the second arc-shaped region 10*k* of the top plate portion can be reduced, and as a result it is possible to reduce the occurrence of cracks.

Further, by using the blank holders 32 and 33 together with the pad 41, the generation of wrinkles in the Y region of the curved outer side of the first arc-shaped region 10*j* of the top plate portion can be reduced. As a result, it is possible to reduce changes in the plate thickness of the press-formed product.

Hereunder, embodiments of the present invention are described while referring to the drawings.

First Embodiment

FIG. 5 is a cross-sectional view that schematically illustrates a press-forming apparatus of a first embodiment of the present invention. A press-forming apparatus 20 of the first embodiment is used in drawing for producing the specific press-formed product 10 that is shown in the above described FIG. 3. Note that the cross-section shown in FIG. 5 is a cross-section along a line B-B in the above described FIG. 3(*a*). The same applies with respect to a second embodiment and a third embodiment which are described later.

The press-forming apparatus 20 includes a ram 61, an upper die 40, a lower die 30, a bolster 62 and a cushion 35. The ram 61 slides in a pressing direction (vertical direction).

The cushion 35 is arranged below the bolster 62. The cushion 35 generates a uniform pressure in the upward direction by means of a spring or a fluid pressure or the like. Note that a blank metal plate 70 is also shown in FIG. 5.

The lower die 30 includes a punch 31, a first blank holder 32 and a second blank holder 33. The punch 31 has a die impression in which the shape of the press-formed product 10 is reflected. In other words, the punch 31 has an end face 31*a* which has a shape that corresponds to the top plate portion 10*a* of the press-formed product 10. In addition, the punch 31 has a first outer side face 31*b* which has a shape that corresponds to the first vertical wall portion 10*b*, and also has a second outer side face 31*c* which has a shape that corresponds to a second vertical wall portion 10*c*. Accordingly, similarly to the press-formed product 10, the shape in a planar view of the punch 31 is a shape that curves in an L shape along the longitudinal direction.

The first blank holder 32 is arranged on a curved inner side of the punch 31, and is adjacent to the punch 31. The second blank holder 33 is arranged on a curved outer side of the punch 31, and is adjacent to the punch 31.

The first blank holder 32 and the second blank holder 33 are mounted at an upper end of a cushion pin 34, respectively. The cushion pins 34 penetrate through the bolster 62 and are supported so as to be individually movable in the pressing direction (vertical direction). The lower ends of the cushion pins 34 are pressed against the cushion 35. Therefore, the first blank holder 32 and the second blank holder 33 are slidably supported in the pressing direction while an upward restoring force is imparted thereto by the cushion 35 via the cushion pins 34.

A stopper 56 that is fixed to the press-forming apparatus and that is used for limiting a sliding movement of the first blank holder 32 is provided on the cushion pin 34 that supports the first blank holder 32. The stopper 56 constitutes a restriction mechanism that restricts sliding of the first blank holder 32, and also restricts sliding of a preceding portion 54 of a die that is described later. The first blank holder 32 is mounted to the cushion pin 34 in a state in which the first blank holder 32 is detachable from the cushion pin 34.

The upper die 40 includes a die 50 (51 to 53) and the pad 41. The die 50 is constituted by a die plate 51, a first die 52 and a second die 53, and has a die impression in which the shape of the press-formed product 10 in a state in which these dies are integrated is reflected. In terms of the die impression, the pad 41 constitutes one part of the die 50, and has an end face having a shape that corresponds to the top plate portion 10*a* of the press-formed product 10. In other words, the pad 41 is arranged facing the end face 31*a* of the punch 31.

The first die 52 faces the first blank holder 32. In other words, the first die 52 is arranged on the curved inner side of the punch 31 (press-formed product 10). The first die 52 has a first guide face 50*c* which has a shape that corresponds to the first flange portion 10*d* of the press-formed product 10. In addition, the first die 52 has a first inner side face 50*a* which has a shape that corresponds to the first vertical wall portion 10*b* of the press-formed product 10. The first inner side face 50*a* is also a shape that corresponds to the first outer side face 31*b* of punch 31.

The second die 53 faces the second blank holder 33. In other words, the second die 53 is arranged on the curved outer side of the punch 31 (press-formed product 10). The second die 53 has a second guide face 50*d* which has a shape that corresponds to the second flange portion 10*e* of the press-formed product 10. In addition, the second die 53 has a second inner side face 50*b* which has a shape that corresponds to the second vertical wall portion 10*c* of the press-formed product 10. The second inner side face 50*b* is also a shape that corresponds to the second outer side face 31*c* of the punch 31.

The preceding portion 54 is provided in the first die 52 that is arranged on the curved inner side of the punch 31 (press-formed product 10). Among the entire region of the first guide face 50*c* and the first inner side face 50*a*, the preceding portion 54 includes at least a region that corresponds to the curved region of the top plate portion 10*a* of the press-formed product 10. In other words, the preceding portion 54 constitutes one part of the first guide face 50*c* and the first inner side face 50*a* of the first die 52. As described using FIG. 9 that is described later, a boundary portion 10*h* between the first flange portion 10*d* and the first vertical wall portion 10*b* of the press-formed product 10 includes a substantially quarter arc-shaped region 10*l* (first arc-shaped region of the flange portion) that curves along a curved region of the top plate portion 10*a*. For example, the first guide face 50*c* of the preceding portion 54 corresponds to a region 10*n* that includes a region on a curved inner side of the first arc-shaped region 10*l* of the flange portion.

The preceding portion 54 may be integrated with the first die 52, or may be a portion that is separated and independent from the first die 52. In FIG. 5, an example is illustrated in which the preceding portion 54 is integrated with the first die 52. The preceding portion 54 (first die 52) is supported via a preceding portion pressurizing mechanism (for example, a spring, rubber, a gas cylinder or a hydraulic cylinder) 55. By this means, the preceding portion 54 is slidable in the pressing direction. On the other hand, the second die 53 is fixed by, for example, a bolt to the die plate 51. Accordingly, the first guide face 50*c* of the preceding portion 54 is slidable relative to the second guide face 50*d* of the second die 53.

The pad 41 is supported via a pad pressurizing mechanism (for example, a spring, rubber, a gas cylinder or a hydraulic cylinder) 42. By this means, the pad 41 is slidable in the pressing direction. Of the entire region of the end face 31*a* of the punch 31, the pad 41 faces at least a region that corresponds to the curved region of the top plate portion 10*a* of the press-formed product 10. In other words, the pad 41 constitutes one part of the die 50. For example, as described using FIG. 10 that is described later, the pad 41 corresponds to a region 10*m* that includes a region on a curved outer side of the first arc-shaped region 10*j* of the top plate portion of the press-formed product 10. In the top plate portion 10*a* of the press-formed product 10, the region 10*m* that corresponds to the pad 41, and particularly a region of the region 10*m* which is adjacent to the first arc-shaped region 10*j* of the top plate portion, is a region in which wrinkles are liable to arise (hereunder, also referred to as "wrinkle occurrence region").

Figure 1:
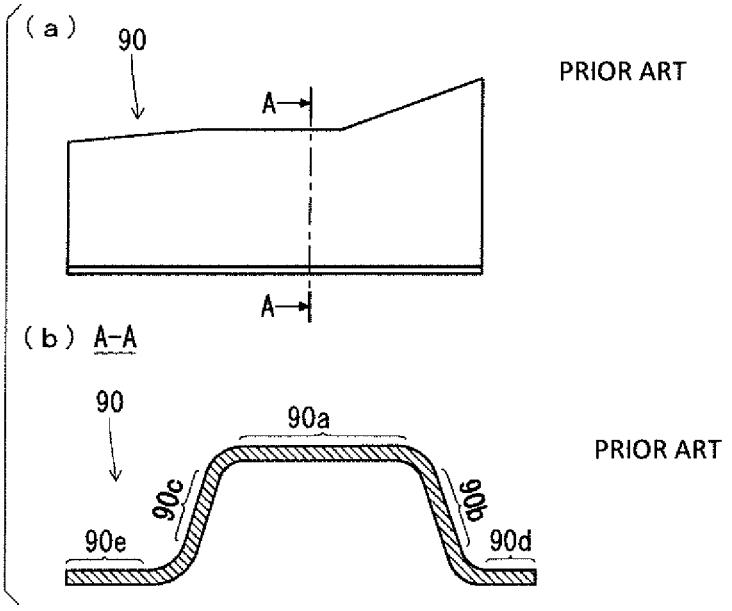
FIGS. 1(*a*) and (*b*) are views that schematically illustrate one example of a press-formed product having a hat-shaped cross section.
Figure 2:
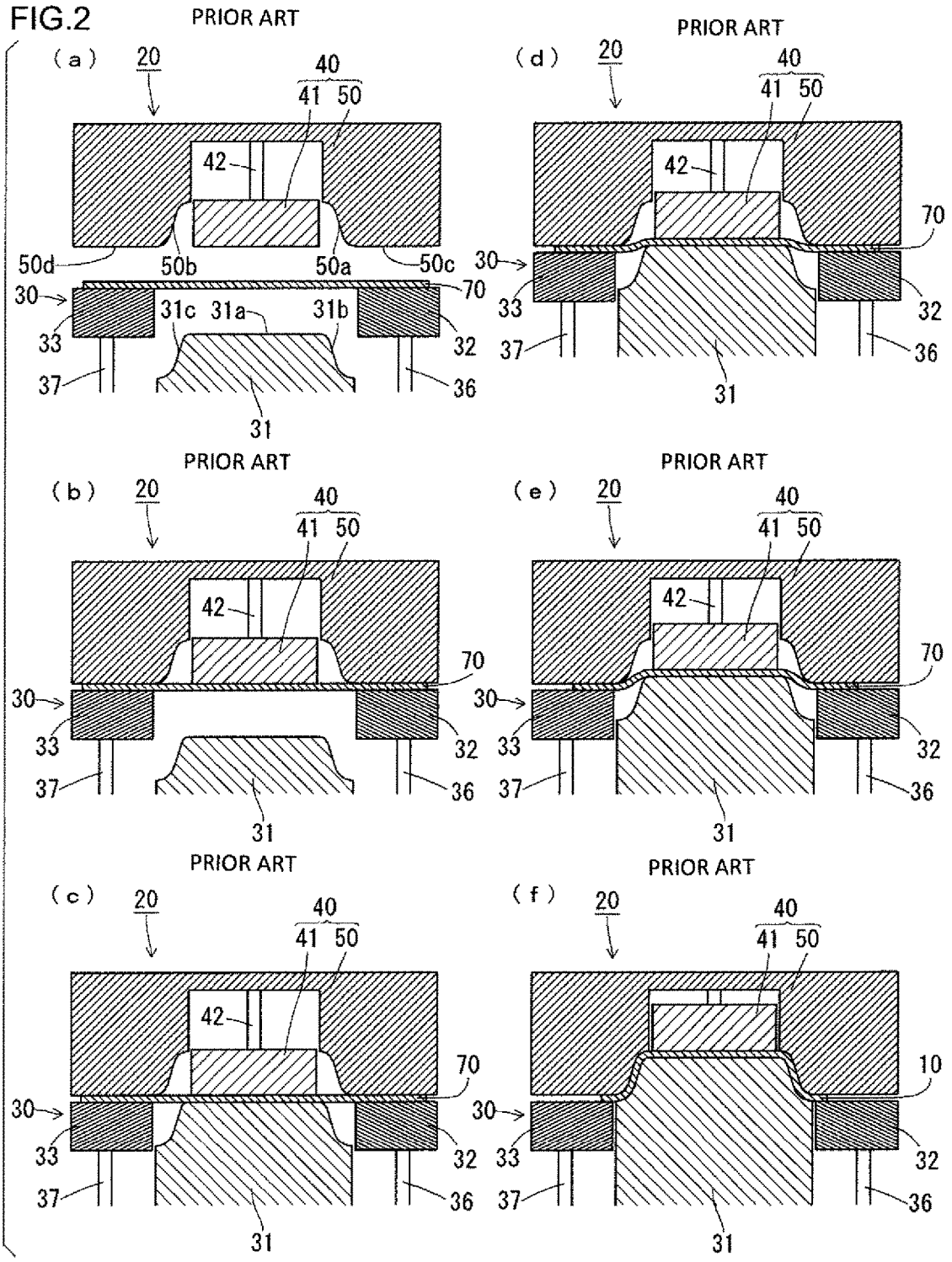
FIG. 2(*a*) to FIG. 2(*f*) are cross-sectional views that schematically illustrate working processes of conventional common press-forming.
Figure 3:
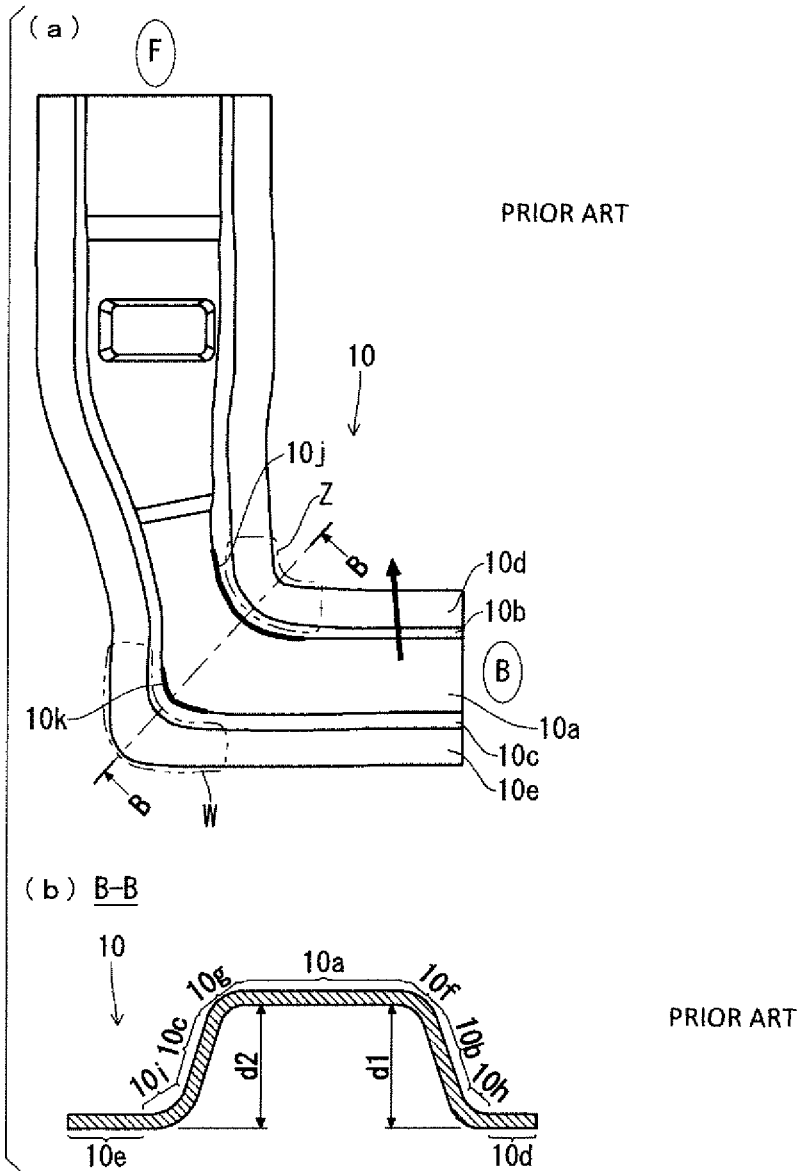
FIGS. 3(*a*) and (*b*) are views that schematically illustrate a different example of a press-formed product having a hat-shaped cross section.

The specific press-formed product 10 illustrated in the above described FIG. 3 is produced through the following processes using the press-forming apparatus 20 having the above described configuration.

Figure 6:
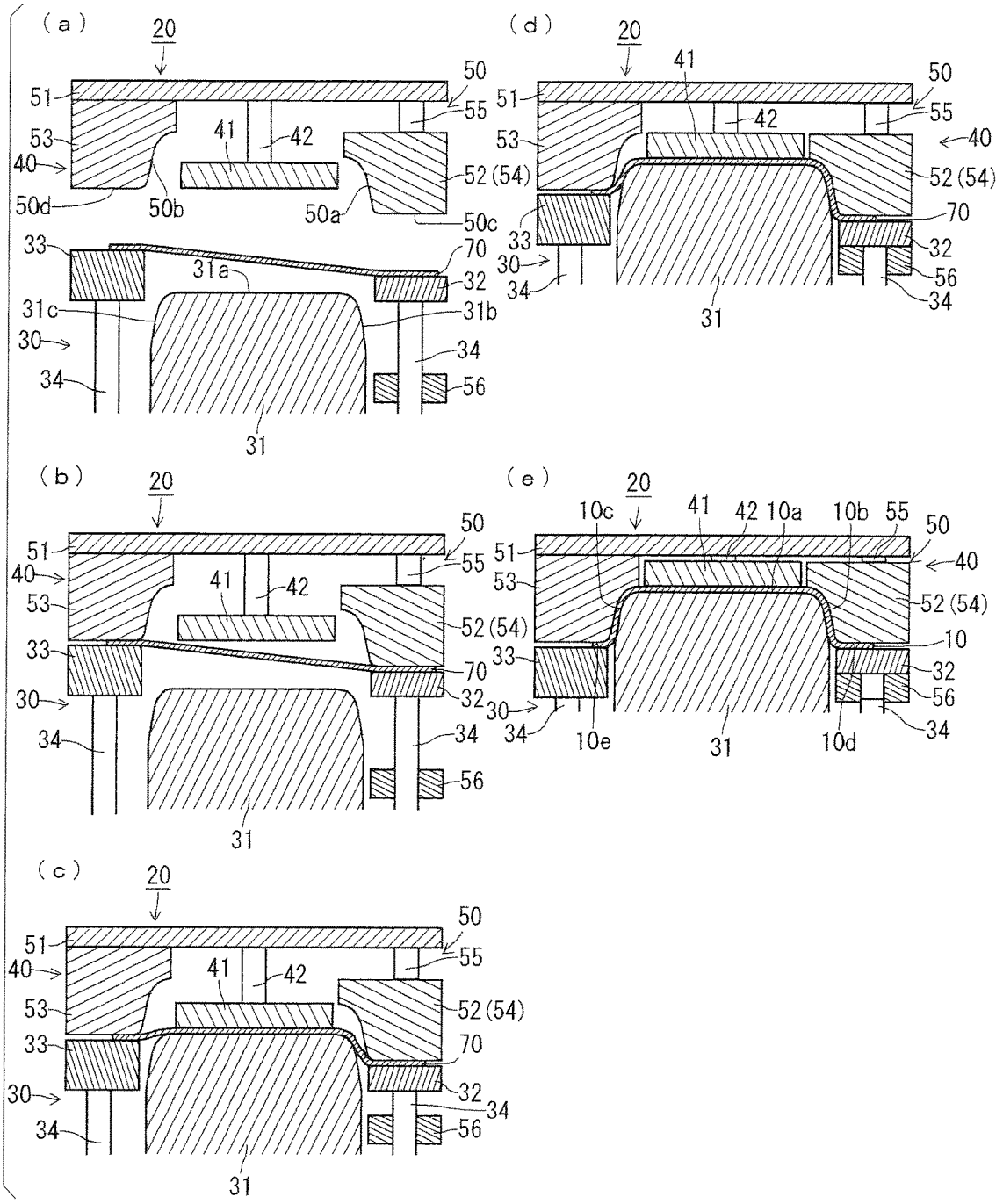
FIGS. 6(*a*) to (*e*) are cross-sectional views that schematically illustrate working processes of press-forming by the press-forming apparatus of the first embodiment of the present invention.

FIGS. 6(*a*) to (*e*) are cross-sectional views that schematically illustrate working processes of press-forming (drawing) by the press-forming apparatus of the first embodiment of the present invention. Among these figures, FIG. 6(*a*) illustrates a state before the start of forming. FIG. 6(*b*) illustrates a state in which a blank metal plate is sandwiched by the blank holders. FIG. 6(*c*) illustrates a state in which the blank metal plate is sandwiched using the pad. FIG. 6(*d*)

illustrates a state at a time point at which the preceding portion is restricted. FIG. 6(*e*) illustrates a state when forming is completed.

In the state before forming, as shown in FIG. 6(*a*), the upper die 40 is at top dead center, and is separated in the upward direction from the lower die 30. In this state, with regard to the upper die 40, the end face of the pad 41 and the second guide face 50*d* of the second die 53 are arranged at the same height position. However, the end face of the pad 41 may also be arranged at a higher position than the second guide face 50*d* of the second die 53. The first guide face 50*c* of the preceding portion 54 (first die 52) is arranged at a lower position than the second guide face 50*d* of the second die 53. On the other hand, with regard to the lower die 30, the first blank holder 32 and the second blank holder 33 are arranged at a higher position than the punch. Further, the first blank holder 32 is arranged at a higher position than the second blank holder 33. According to this arrangement of the upper die 40, at the time of press-forming, the first guide face 50*c* of the preceding portion 54 precedes the second guide face 50*d* of the second die 53. Further, the blank metal plate 70 is placed on the lower die 30 (strictly speaking, on the first blank holder 32 and the second blank holder 33).

From this state, the upper die 40 descends and the punch 31 and the die 50 move relatively in the pressing direction. Thereupon, as shown in FIG. 6(*b*), the first guide face 50*c* of the first die 52 and the preceding portion 54 butts against the first blank holder 32 via the blank metal plate 70. In accompaniment therewith, the second guide face 50*d* of the second die 53 butts against the second blank holder 33 via the blank metal plate 70. By this means the blank metal plate 70 is sandwiched by the preceding portion 54 (first die 52) and the first blank holder 32, and is also sandwiched by the second die 53 and the second blank holder 33. At such time, a restoring force of the cushion 35 is imparted through the cushion pins 34 to the first blank holder 32 and the second blank holder 33. Further, a restoring force of the preceding portion pressurizing mechanism 55 is imparted to the preceding portion 54.

Next, the upper die 40 descends further. Thereupon, as shown in FIG. 6(*c*), the pad 41 butts against the punch 31 via the blank metal plate 70. As a result, the blank metal plate 70 is sandwiched by the punch 31 and the pad 41. At such time, a restoring force of the pad pressurizing mechanism 42 is imparted to the punch 31.

The restoring force of the preceding portion pressurizing mechanism 55 that is imparted to the preceding portion 54 is greater than the restoring force of the cushion 35 that is imparted to the first blank holder 32. Consequently, the first blank holder 32 is pushed downward by the preceding portion 54, and as shown in FIG. 6(*c*), a state in which the first guide face 50*c* of the preceding portion 54 precedes the second guide face 50*d* of the second die 53 is maintained.

In the state in which the blank metal plate 70 is sandwiched in this manner, the upper die 40 descends further. Thereupon, in the state in which the first guide face 50*c* of the preceding portion 54 precedes the second guide face 50*d* of the second die 53, the punch 31 is pressed into the die 50, and the blank metal plate 70 is worked. In due course, as shown in FIG. 6(*d*), the blank metal plate 70 is pressed against the first outer side face 31*b* of the punch 31 to thereby substantially complete forming of the first vertical wall portion 10*b* in the blank metal plate 70. Forming of the first vertical wall portion 10*b* is also performed by the first inner side face 50*a* of the first die 52 (preceding portion 54) being pressed against the blank metal plate 70. Further, forming of the first flange portion 10*d* in the blank metal plate 70 by the preceding portion 54 and the first blank holder 32 is substantially completed. On the other hand, since the state is one in which the first guide face 50*c* of the preceding portion 54 precedes the second guide face 50*d* of the second die 53, forming of the second vertical wall portion 10*c* and the second flange portion 10*e* is continuing.

When the first vertical wall portion 10*b* and first flange portion 10*d* are formed in advance from the blank metal plate 70, the blank metal plate 70 is drawn to the preceding portion 54 side (first die 52 side) on the curved inner side. More specifically, the blank metal plate 70 is drawn in a direction indicated by a solid line arrow in the above described FIG. 3.

As shown in FIG. 6(*d*), in a state in which forming of the first vertical wall portion 10*b* and the first flange portion 10*d* is completed, sliding of the first blank holder 32 and the preceding portion 54 is restricted by the restriction mechanism (stopper) 56. By this means, a further change in the shape of the formed first vertical wall portion 10*b* and first flange portion 10*d* is prevented. Following restriction of sliding of the first blank holder 32 in this way, sliding of the preceding portion 54 relative to the punch 31 is also restricted.

The upper die 40 then descends further. Thereupon, because sliding of the first blank holder 32 and the preceding portion 54 relative to the punch 31 is restricted, the first blank holder 32 and the cushion pin 34 separate from each other, and the preceding portion 54 is pressed to the die plate 51 side. On the other hand, the second die 53 descends, and working of the second vertical wall portion 10*c* and the second flange portion 10*e* continues.

Subsequently, as shown in FIG. 6(*e*), the upper die 40 reaches bottom dead center. By this means, forming of the second vertical wall portion 10*c* and the second flange portion 10*e* is completed. By performing press-forming in this way, the specific press-formed product 10 illustrated in the above described FIG. 3 is produced.

Figure 4:
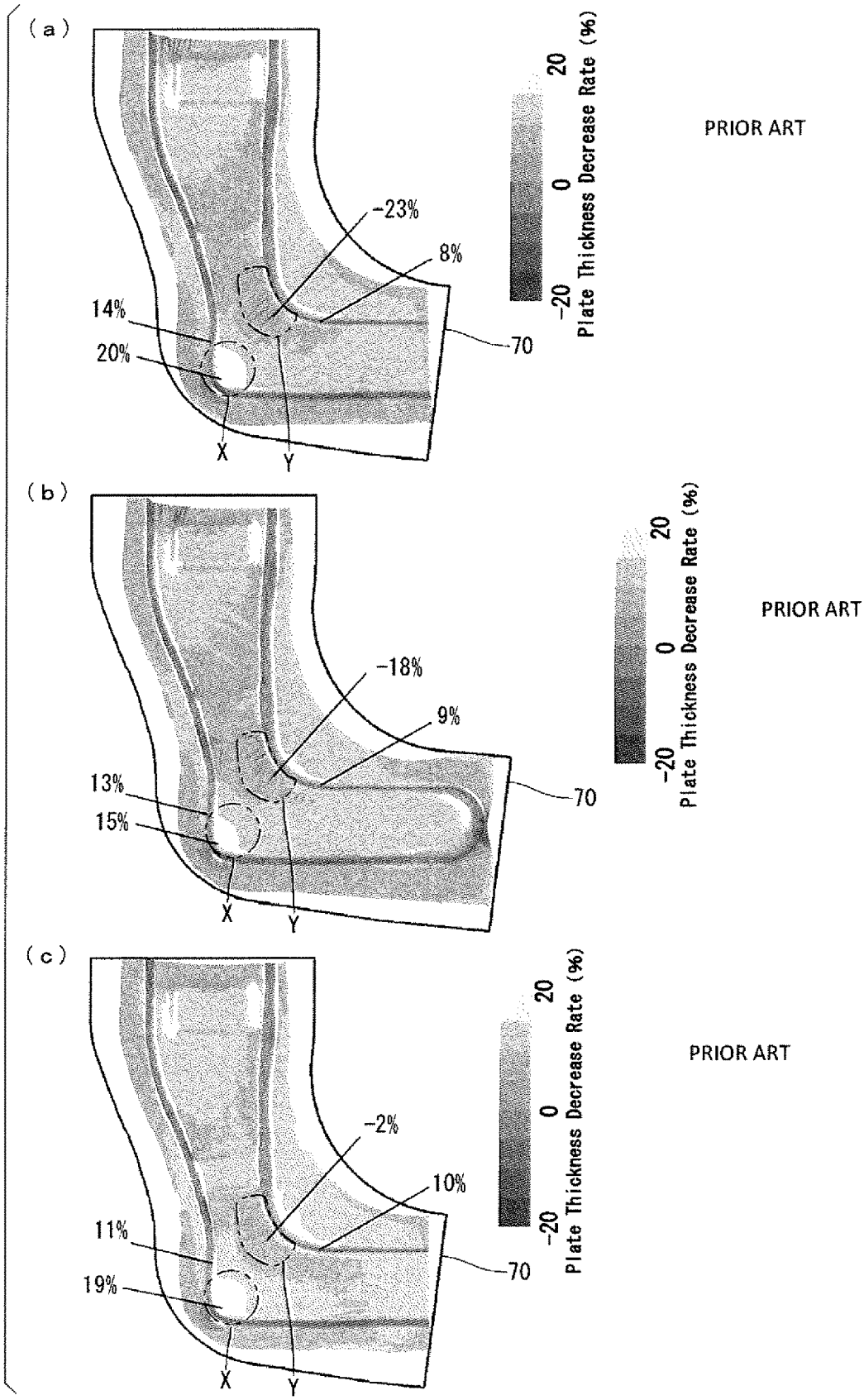
FIGS. 4(*a*) to (*c*) are views that illustrate the distribution of a plate thickness decrease rate when a specific press-formed product is produced by press-forming.

According to the press-forming of the present embodiment, when forming of the first vertical wall portion 10*b* and the first flange portion 10*d* is substantially completed, the blank metal plate 70 is drawn in towards the preceding portion 54 side (first die 52 side) on the curved inner side. By this means, a state is entered in which there is a surplus of the blank metal plate 70 in the second arc-shaped region 10*k* of the top plate portion and the vicinity thereof. From this state, forming of the second vertical wall portion 10*c* by the end face 31*a* and the second outer side face 31*c* of the punch 31 progresses and is completed. Therefore, even when a high-strength metal plate, for example, a metal plate having a tensile strength (TS) of 590 MPa or more is used as the blank metal plate 70, a thickness reduction in the X region (top plate portion 10*a*; see FIG. 4) on the curved inner side of the second arc-shaped region 10*k* of the top plate portion can be decreased, and as a result the occurrence of cracks can be reduced. In accompaniment therewith, a thickness reduction can also be decreased in the second vertical wall portion 10*c* on the curved outer side of the X region.

Further, according to the press-forming of the present embodiment, the pad 41 butts against the blank metal plate 70 on at least the curved outer side of the first arc-shaped region 10*j* of the top plate portion. As a result of the blank metal plate 70 being sandwiched by the pad 41 and the punch 31, the formation of wrinkles can be reduced in the Y region (top plate portion 10*a*; see FIG. 4) on the curved outer side of the first arc-shaped region 10*j* of the top plate portion. In addition, since drawing is performed in a state in which the blank metal plate 70 is sandwiched using the first blank holder 32 and the second blank holder 33, tension that is generated in the width direction of the blank metal plate 70 increases. By this means also, formation of wrinkles in the Y region can be reduced.

In particular, by using the second blank holder 33, formation of wrinkles in the W region (see FIG. 3) on the curved outer side of the second arc-shaped region of the flange portion can also be reduced.

The occurrence of cracks in the Z region (see FIG. 3) on the curved inner side of the first arc-shaped region of the flange portion is reduced by expanding the width of the blank metal plate 70. This is because, at the time of press-forming, a region located on the back side in the longitudinal direction of the blank metal plate 70 is liable to flow in towards the Z region and the periphery thereof, and as a result a portion having excess metal is formed on the curved inner side of the first flange portion 10*d*. A press-formed product of a desired shape can be obtained by removing the portion having excess metal by trimming after press-forming.

As described above, according to the press-forming of the present embodiment, since a thickness reduction in the press-formed product 10 is decreased, the occurrence of cracks can be reduced. Furthermore, wrinkles can be reduced. Consequently, a change in the plate thickness of the press-formed product 10 can be reduced. Therefore, it is possible to obtain the press-formed product 10 in which cracks and wrinkles are reduced. The press-formed product 10 is formed using the blank metal plate 70 which has a tensile strength of 590 MPa or more by the press-forming of the present embodiment. Accordingly, the tensile strength of the press-formed product 10 is 590 MPa or more, preferably 980 MPa or more, and further preferably 1180 MPa or more.

The press-forming of the present embodiment is also applicable to a case where a low-strength metal plate is used as the blank metal plate 70. In such a case, even if the radius of curvature of the first arc-shaped region 10*j* of the top plate portion is small, the press-formed product 10 in which a change in the plate thickness as well as cracks and wrinkles are reduced can be obtained. Naturally, a problem will not arise even if the radius of curvature of the second arc-shaped region 10*k* of the top plate portion is small. Furthermore, a problem will not arise even if the depth d1 of the first vertical wall portion 10*b* or the depth d2 of the second vertical wall portion 10*c* is deep. Accordingly, the degree of freedom in designing the shape of a press-formed product is increased by using the press-forming of the present embodiment.

Second Embodiment

Figure 7:
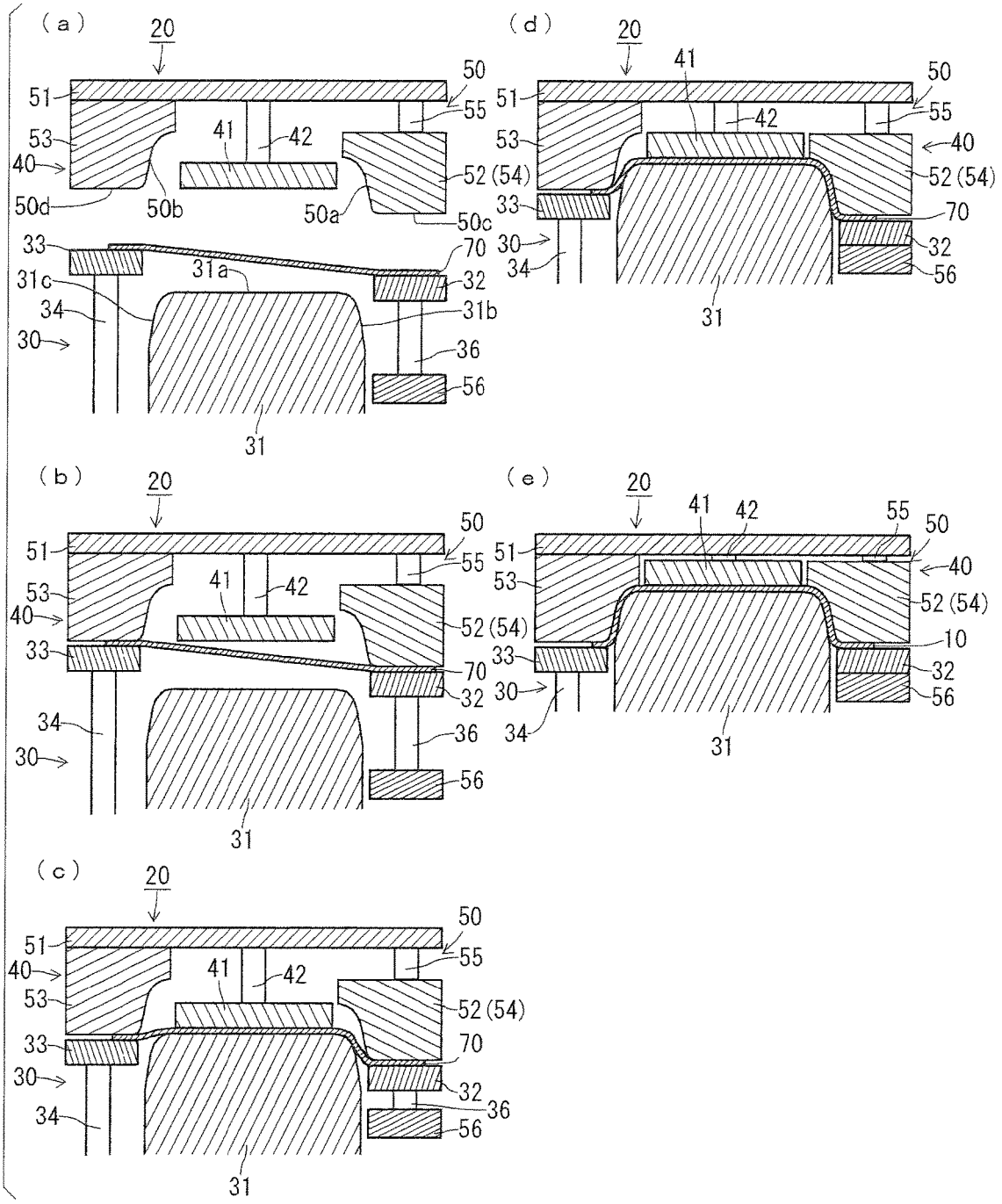
FIGS. 7(*a*) to (*e*) are cross-sectional views that schematically illustrate working processes of press-forming by a press-forming apparatus of a second embodiment of the present invention.

FIGS. 7(*a*) to (*e*) are cross-sectional views that schematically illustrate working processes in press-forming (drawing) by a press-forming apparatus according to a second embodiment of the present invention. Each of these drawings illustrates a similar state as the respective drawings of FIGS. 6(*a*) to (*e*) that are described above.

The press-forming apparatus 20 of the second embodiment is based on the configuration of the press-forming apparatus 20 of the first embodiment illustrated in the above described FIG. 6. The same applies with respect to a third and fourth embodiment that are described later. A difference between the press-forming apparatus 20 of the second embodiment and the press-forming apparatus 20 of the first embodiment is that the shape of the restriction mechanism is changed. In the second embodiment, the first blank holder 32 is slidably supported in the pressing direction by a first blank holder pressurizing mechanism 36 instead of a cushion pin. For example, a spring, rubber, a gas cylinder or a hydraulic cylinder or the like can be employed as the first blank holder pressurizing mechanism 36.

In the second embodiment, sliding of the first blank holder 32 is limited by the stopper 56 through the first blank holder pressurizing mechanism 36. The first blank holder 32 is restricted as a result of such limiting, and sliding of the preceding portion 54 is restricted following such restriction of the first blank holder 32.

Third Embodiment

Figure 8:
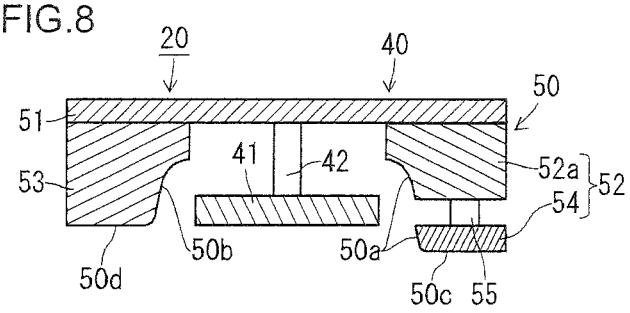
FIG. 8 is a cross-sectional view that schematically illustrates an upper die in a press-forming apparatus of a third embodiment of the present invention.

FIG. 8 is a cross-sectional view that schematically illustrates an upper die in a press-forming apparatus according to a third embodiment of the present invention. A difference between the press-forming apparatus 20 of the third embodiment and the press-forming apparatus 20 of the first and second embodiments is that the shape of the upper die 40 is changed. In the third embodiment, the first die 52 is constituted by a first die main body 52*a* and a preceding portion 54. The preceding portion 54 of the third embodiment constitutes the entire area in the width direction with regard to the first guide face 50*c*, and constitutes one portion in the vicinity of the first guide face 50*c* with regard to the first inner side face 50*a*. The first die main body 52*a* constitutes the remainder of the first inner side face 50*a* excluding the preceding portion 54. The first die main body 52*a* is fixed to the die plate 51. The preceding portion 54 is supported through the preceding portion pressurizing mechanism 55 that is fixed to the first die main body 52*a*.

In the case of the third embodiment, a die parting line exists between the preceding portion 54 and the first die main body 52*a*. There is a risk that the die parting line will be transferred onto the press-formed product 10. Therefore, from the viewpoint of ensuring the surface quality of the press-formed product 10, it is preferable to adopt the preceding portion 54 as described in the foregoing first and second embodiments.

In the above described first to third embodiments, the preceding portion 54 constitutes the entire area in the width direction of the first guide face 50*c*. However, as long as press-forming (drawing) of the blank metal plate 70 can be performed, a form may also be adopted in which the preceding portion 54 constitutes one part in the width direction of the first guide face 50*c*.

Further, although the preceding portion 54 may be provided across the entire area in the longitudinal direction of the first die 52, a configuration may also be adopted in which the preceding portion 54 is partially provided in the longitudinal direction of the first die 52. If the preceding portion 54 is partially provided, a die parting line will exist. The die parting line may be appropriately set, for example, in accordance with constraints with respect to the surface quality of the press-formed product 10, and furthermore, in accordance with an offset load applied to a die and a press machine. Indeed, from the viewpoint of ensuring the surface quality of the press-formed product 10, it is preferable that the preceding portion 54 is provided across the entire area in the longitudinal direction of the first die 52.

Figure 9:
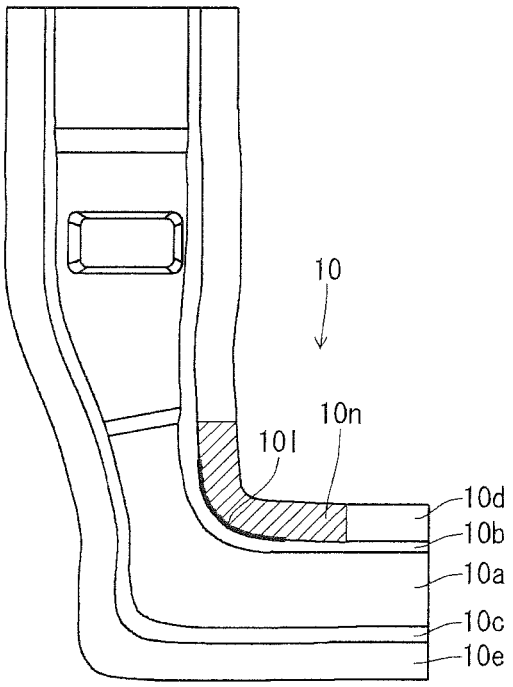
FIG. 9 is a plan view of a press-formed product that schematically illustrates an example of a region which a preceding portion butts against at bottom dead center.

FIG. 9 is a plan view of a press-formed product that schematically illustrates one example of a region that the preceding portion butts against at bottom dead center. The preceding portion 54 butts against at least a region 10*n* (see hatched portion in FIG. 9) on the curved inner side of the first arc-shaped region 10*l* of the flange portion (thick line in FIG. 9). This is to decrease a thickness reduction in the X region (see FIG. 4) on the curved inner side of the second arc-shaped region 10*k* of the top plate portion. Together therewith, it is to reduce the occurrence of cracks in the Z region (see FIG. 3) of the first flange portion 10*d*.

Figure 10:
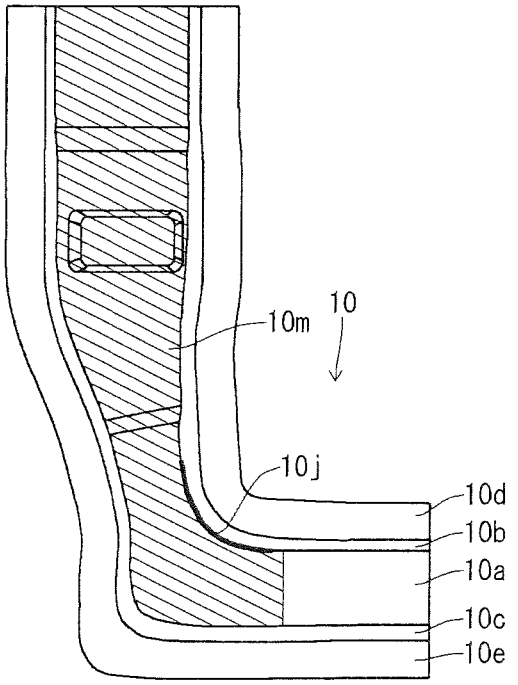
FIG. 10 is a plan view of a press-formed product that schematically illustrates an example of a region which a pad butts against at bottom dead center.

FIG. 10 is a plan view of a press-formed product that schematically illustrates an example of a region that the pad butts against at bottom dead center. The pad 41 butts against at least a region 10*m* (see hatched portion in FIG. 10) on the curved outer side of the first arc-shaped region 10*j* of the top plate portion (see thick line in FIG. 10). This is to reduce wrinkles in the Y region (see FIG. 4) of the top plate portion 10*a*. As shown in FIG. 10, the region 10*m* that the pad 41 butts against may include, among the entire region of the top plate portion 10*a*, a frontward region in the longitudinal direction of the curved region. Further, the region 10*m* that the pad 41 butts against may be the entire region of the top plate portion 10*a*. In this case, as necessary, the pad 41 may be arranged in a divided state in the longitudinal direction.

In short, the pad 41 is arranged so as to butt against at least the wrinkle occurrence region of the top plate portion 10*a*. In many cases, the wrinkle occurrence region exists in the Y region (see FIG. 4) on the curved outer side of the first arc-shaped region 10*j* of the top plate portion (see the thick line in FIG. 10). The wrinkle occurrence region can be ascertained by FEM analysis. Further, the wrinkle occurrence region can also be ascertained by producing a press-formed product by a conventional common press-forming method, and examining the surface properties of the press-formed product.

In this case, as described above, the occurrence of cracks in the Z region (see FIG. 3) on the curved inner side of the first arc-shaped region of the flange portion can be reduced by expanding the width of the blank metal plate 70 and forming a portion having excess metal on the curved inner side of the first flange portion 10*d*. In such a case, at the time of press-forming, a region that is located on the back side in the longitudinal direction of the blank metal plate 70 flows in towards the Z region and the periphery thereof. To prevent the aforementioned inflow from being obstructed, in a case where the pad 41 is caused to butt against the region located on the back side in the longitudinal direction of the blank metal plate 70, it is preferable to appropriately set the pressing force of the pad 41.

In the press-forming of the present embodiment, the first guide face 50*c* of the preceding portion 54 is arranged so as to precede the second guide face 50*d* of the second die 53. A preceding amount m (unit: mm; see FIG. 5) of the preceding portion 54 is set by taking as an index a ratio (hereunder, also referred to as "preceding amount ratio") R that the preceding amount m occupies with respect to the depth d2 (unit: mm; see FIG. 3(*b*)) of the second vertical wall portion 10*c*. The preceding amount m of the preceding portion 54 is appropriately set in accordance with the shape of the press-formed product 10 and the material quality of the blank metal plate 70, and for example is set so that the preceding amount ratio R is 3 to 100%. From the viewpoint of further reducing the occurrence of cracks in the X region (see FIG. 4), the viewpoint of an offset load that is loaded on the die and the press machine, and the viewpoint of reducing the occurrence of wrinkles while improving production efficiency, it is preferable to set the preceding amount m of the preceding portion 54 so that the preceding amount ratio R is 10 to 70%. The preceding amount m can also be said to be a stroke difference between the preceding portion 54 and the second die 53 (that is, a difference between the respective remaining strokes until bottom dead center) during a pushing-in process.

The arrangement of the preceding portion 54 at an early stage of a pushing-in process can be evaluated by means of a height difference n (unit: mm; see the above described FIG. 5) between the first guide face 50*c* of the preceding portion 54 and the second guide face 50*d* of the second die 53. The height difference n takes a positive value in a state in which the first guide face 50*c* of the preceding portion 54 protrudes relative to the second guide face 50*d* of the second die 53, as shown in the aforementioned FIG. 5, and takes a negative value in a state in which the second guide face 50*d* protrudes relative to the first guide face 50*c* of the preceding portion 54.

In the press-forming of the present embodiment, whatever value the height difference n between the first guide face 50*c* and the second guide face 50*d* is among a positive value, 0 (zero) and a negative value, the occurrence of cracks in the X region can be reduced. From the viewpoint of reducing the occurrence of cracks in the X region to a greater extent, preferably the height difference n between the first guide face 50*c* and the second guide face 50*d* is made a positive value, and the state in the early stage of the pushing-in process is a state in which the first guide face 50*c* of the preceding portion 54 protrudes relative to the second guide face 50*d* of the second die 53. On the other hand, from the viewpoint of an offset load that is loaded on the die and the press machine as well as from the viewpoint of reducing the occurrence of wrinkles while improving the production efficiency, preferably the height difference n between the first guide face 50*c* and the second guide face 50*d* is made a smaller value than the depth d1 of the first vertical wall portion 10*b*.

A boundary portion 10*i* between the second vertical wall portion 10*c* and the second flange portion 10*e* of the press-formed product 10 includes a substantially quarter arc-shaped region 10*q* (second arc-shaped region of the flange portion) that curves along a curved region of the top plate portion 10*a* (see FIG. 12 that is described later). In the press-forming of the present embodiment, a distance between the second blank holder 33 and the second die 53 is preferably maintained in a state in which the distance is greater than the plate thickness of the blank metal plate 70 at least in a region on the curved outer side of the second arc-shaped region 10*q* of the flange portion. By this means, it is possible to promote an inflow into the die impression of the die 50 of a region of the blank metal plate 70 that butts against the second blank holder 33. As a result, a thickness reduction in the X region (see FIG. 4) of the press-formed product 10 can be decreased. Furthermore, a thickness reduction can also be decreased in the second vertical wall portion 10*c* on the curved outer side of the X region.

A configuration that maintains a distance between the second blank holder 33 and the second die 53 in a state in which the distance is greater than the plate thickness of the blank metal plate 70 can be realized, for example, by providing a step height in mutually facing surfaces of the second blank holder 33 and the second die 53. Further, for example, such a configuration can be realized by providing, between the second blank holder 33 and the second die 53, a distance block that serves as a die surface contacting portion of the second blank holder 33 and the second die 53. Such a configuration can also be realized by combining the second blank holder 33 and the second die 53.

In the case of adopting a configuration that maintains a distance between the second blank holder 33 and the second die 53 in a state in which the distance is greater than the plate thickness of the blank metal plate 70, if the distance between the second blank holder 33 and the second die 53 is too large, there is a risk that wrinkles will arise in the W region (see FIG. 3). Therefore, it is sufficient to appropriately set the distance between the second blank holder 33 and the second die 53 to a level such that wrinkles do not arise in the W region. The distance d (mm) between the second blank holder 33 and the second die 53 can be set, for example, so as to satisfy the following Formula (2).

$$tb \times 1.01 \leq d \leq tb \times 1.50 \quad (2)$$

In the above Formula (2), tb represents the plate thickness (mm) of the blank metal plate.

As described above, in a case where cracks in the Z region (see FIG. 3) is reduced by forming a portion having excess metal on a curved inner side of the first flange portion 10*d*, it is more preferable to maintain a distance between the second blank holder 33 and the second die 53 in a state in which the distance is greater than the plate thickness of the blank metal plate 70 in a region (see hatched portion denoted by reference character "10*p*" in FIG. 12 that is described later) that, among the entire region of the second flange portion 10*e*, is rearward in the longitudinal direction from the second arc-shaped region 10*q* of the flange portion. In addition, it is more preferable to maintain a distance between the first blank holder 32 and the first die 52 (preceding portion 54) in a state in which the distance is greater than the plate thickness of the blank metal plate 70 in a region (see hatched portion denoted by reference character "10*o*" in FIG. 12 that is described later) that, among the entire region of the first flange portion 10*d*, is rearward in the longitudinal direction from the first arc-shaped region 10*l* of the flange portion.

By this means, a thickness reduction in the X region (see FIG. 4) of the press-formed product 10 can be decreased, and a thickness reduction can also be decreased in the second vertical wall portion 10*c* on the curved outer side of the X region. Furthermore, an effect that reduces cracks in the Z region (see FIG. 3) is enhanced.

In the press-forming of the present embodiment there is not limitation with respect to the order of sandwiching the blank metal plate 70. Sandwiching using the pad 41 may be executed after sandwiching by the first blank holder 32 and second blank holder 33 as in the working processes illustrated in the above described FIG. 6 and FIG. 7, or sandwiching may be executed in the reverse order thereto.

Although in the press-forming apparatus illustrated in the above described FIG. 5 to FIG. 8 a configuration is adopted in which a die and a pad are arranged as an upper die, and a punch and blank holders are arranged as a lower die, a configuration may also be adopted in which the arrangement of the upper and lower dies is inverted in the vertical direction.

Note that, a restriking process may be added after the press-forming of the present embodiment. In the restriking process a region having an incomplete shape (for example, a minute R portion or the like) is finished into a final shape.

The specific press-formed product 10 that is produced by the press-forming of the present embodiment is applied not only to a front pillar lower outer reinforcement, but also to structural members such as a side sill inner, a side sill outer reinforcement rear, a front side member and a rear side member.

In the case of a specific press-formed product that is applied to the aforementioned structural members, a central angle of the first arc-shaped region 10*j* of the top plate portion and the second arc-shaped region 10*k* of the top plate portion is designed to be, for example, 15 to 120°. Further, the radius of curvature of the first arc-shaped region 10*j* of the top plate portion is designed to be, for example, 30 to 600 mm. The radius of curvature of the second arc-shaped region 10*k* of the top plate portion is designed to be, for example, 10 to 600 mm, or ∞ (a straight line). The depth d1 of the first vertical wall portion 10*b* is designed to be, for example, 20 to 300 mm, and the depth d2 of the second vertical wall portion 10*c* is designed to be, for example, 20 to 300 mm.

More specifically, in a case of using the specific press-formed product as a rear side member, the central angle of the arc-shaped regions 10*j* and 10*k* is set to, for example, 15 to 85°. Further, the radius of curvature of the first arc-shaped region 10*j* of the top plate portion is set to, for example, 30 to 600 mm. The radius of curvature of the second arc-shaped region 10*k* of the top plate portion is set to, for example, 30 to 600 mm. The depth d1 of the first vertical wall portion is set to, for example, 30 to 300 mm, and the depth d2 of the second vertical wall portion is set to, for example, 30 to 300 mm.

In a case of using the specific press-formed product as a front pillar lower outer reinforcement, the central angle of the arc-shaped regions 10*j* and 10*k* is set to, for example, 60 to 120°. Further, the radius of curvature of the first arc-shaped region 10*j* of the top plate portion is set to, for example, 30 to 200 mm. The radius of curvature of the second arc-shaped region 10*k* of the top plate portion is set to, for example, 10 to 200 mm. The depth d1 of the first vertical wall portion and the depth d2 of the second vertical wall portion are set to, for example, 20 to 200 mm.

In the case of using the specific press-formed product as a front pillar inner, the central angle of the arc-shaped regions 10*j* and 10*k* is set to, for example, 60 to 120°. Further, the radius of curvature of the first arc-shaped region 10*j* of the top plate portion is set to, for example, 30 to 200 mm. The radius of curvature of the second arc-shaped region 10*k* of the top plate portion is set to, for example, 10 to 200 mm. The depth d1 of the first vertical wall portion and the depth d2 of the second vertical wall portion are set to, for example, 20 to 200 mm.

In the case of using the specific press-formed product as a side sill outer reinforcement rear, the central angle of the arc-shaped regions 10*j* and 10*k* is set to, for example, 15 to 85°. Further, the radius of curvature of the first arc-shaped region 10*j* of the top plate portion is set to, for example, 30 to 400 mm. The radius of curvature of the second arc-shaped region 10*k* of the top plate portion is set to, for example, 70 to ∞ (a straight line) mm. The depth d1 of the first vertical wall portion and the depth d2 of the second vertical wall portion are set to, for example, 20 to 200 mm.

Fourth Embodiment

Figure 11:
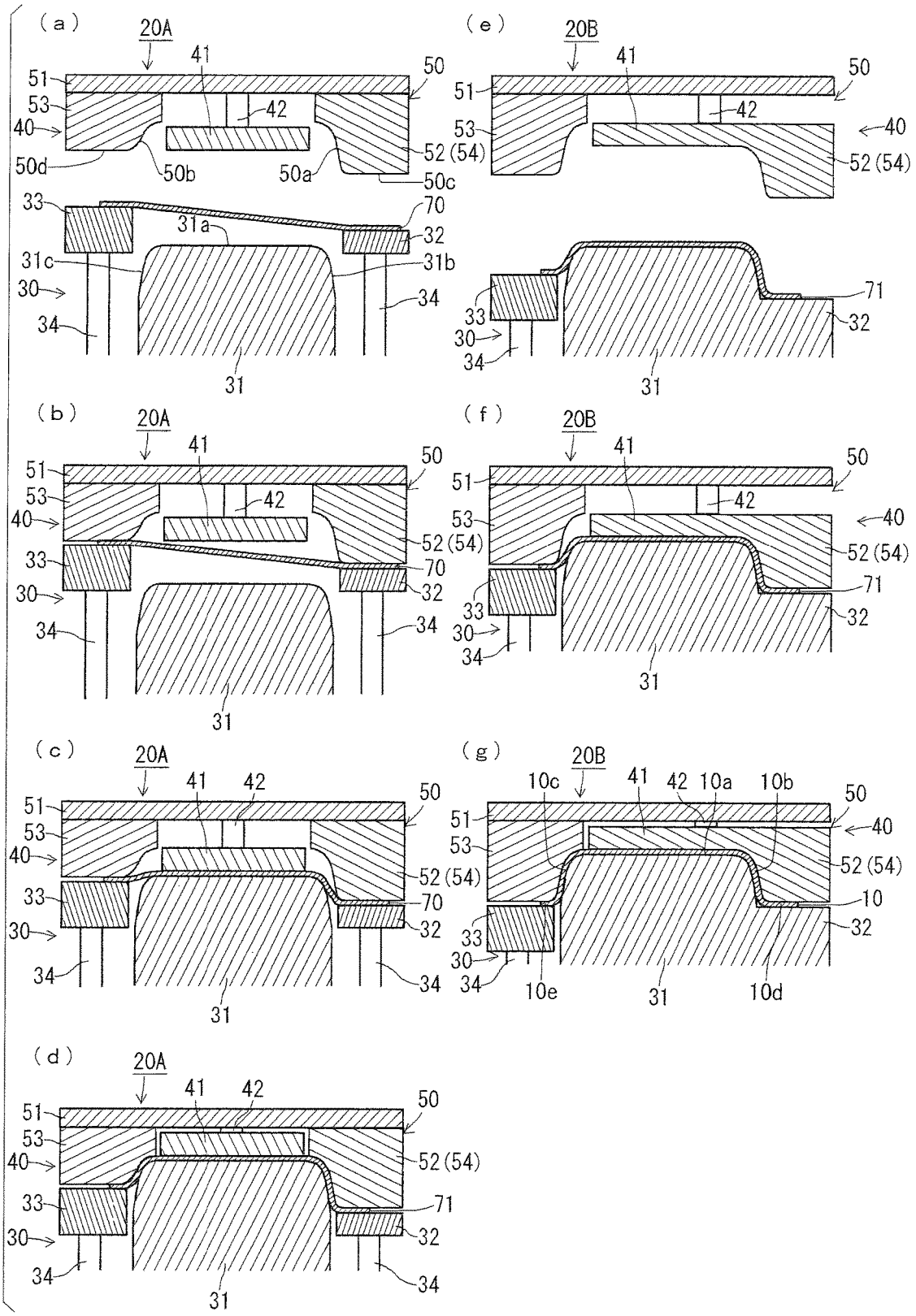
FIGS. 11(*a*) to (*g*) are cross-sectional views that schematically illustrate working processes according to press-forming of a fourth embodiment of the present invention.

FIGS. 11(*a*) to (*g*) are cross-sectional views that schematically illustrate working processes according to press-forming of a fourth embodiment of the present invention. In the fourth embodiment, the working processes of the press-forming are divided into two stages. Although a press-formed product that is ultimately obtained by the press-forming of the fourth embodiment is the same as the press-formed product obtained by the press-forming of the first to third embodiments, the press-formed product obtained according to the fourth embodiment is formed into a finished product after undergoing a first stage and a second stage in order. In other words, separate press-forming apparatuses are used for each stage, with an intermediate product being formed from a blank metal plate in the first stage, and the intermediate product being finished into a finished product in the second stage. Although the intermediate product is a product in which the top plate portion, the first vertical wall portion on the curved inner side of the top plate portion, and the first flange portion that is connected to the first vertical wall portion are completely formed, the intermediate product is also a product in which the second vertical wall portion on the curved outer side of the top plate portion as well as the second flange portion that is connected to the second vertical wall portion are partly formed.

FIGS. 11(*a*) to (*d*) illustrate working processes in the first stage. Among these figures, FIG. 11(*a*) illustrates a state before the start of forming in the first stage. FIG. 11(*b*) illustrates a state in which a blank metal plate is sandwiched by the blank holders. FIG. 11(*c*) illustrates a state in which the blank metal plate is sandwiched using the pad. FIG. 11(*d*) illustrates a state when forming in the first stage is completed. FIGS. 11(*e*) to (*g*) illustrate working processes in the second stage. Among these figures, FIG. 11(*e*) illustrates a state before the start of forming in the second stage. FIG. 11(*f*) illustrates a state when forming starts. FIG. 11(*g*) illustrates a state when forming in the second stage is completed.

As shown in FIGS. 11(*a*) to (*d*), a press-forming apparatus 20A that is used in the first stage differs from the press-forming apparatus 20 of the first and second embodiments in the following respects. With regard to the upper die 40 and the die 50, the first die 52 and the preceding portion 54 that are arranged on the curved inner side of the punch 31 are integrated and fixed to the die plate 51. In other words, the preceding portion pressurizing mechanism 55 included in the first to third embodiments is not provided. Similarly to the first to third embodiments, the die impression of the first die 52 and the preceding portion 54 is a portion in which the shape of the finished product is reflected.

Further, in the first stage, the second die 53 that is arranged on the curved outer side of the punch 31 is fixed to the die plate 51, similarly to the first to third embodiments. However, the die impression of the second die 53 is a portion in which the shape of the finished product is partly reflected. In other words, the depth in the pressing direction of the inner side face 50*b* of the second die 53 is shallower than the depth of the second vertical wall portion of the finished product.

With regard to the lower die 30 used in the first stage, the stopper 56 that limits a sliding movement of the first blank holder 32 as described in the first to third embodiments is not provided.

As shown in FIGS. 11(*e*) to (*g*), a press-forming apparatus 20B that is used in the second stage differs from the press-forming apparatus 20 of the first and second embodiments in the following respects. With regard to the upper die 40 and the die 50, the first die 52 and the preceding portion 54 that are arranged on the curved inner side of the punch 31 are integrated in a manner that includes the pad 41. The integrated first die 52, preceding portion 54 and pad 41 are supported through the pad pressurizing mechanism 42. The preceding portion pressurizing mechanism 55 provided in the first to third embodiments is not provided. Similarly to the first to third embodiments, a die impression of the first die 52, the preceding portion 54 and the pad 41 is a portion in which the shape of the finished product is reflected.

Further, in the second stage, similarly to the first to third embodiments, the second die 53 that is arranged on the curved outer side of the punch 31 is fixed to the die plate 51. Furthermore, similarly to the first to third embodiments, the die impression of the second die 53 is a portion in which the shape of the finished product is reflected.

With regard to the lower die 30 that is used in the second stage, the first blank holder 32 that is adjacent to the curved inner side of the punch 31 is integrated with the punch 31. In other words, the cushion pin 34 that supports the first blank holder 32 in the configurations of the first to third embodiments is not provided.

As shown in FIGS. 11(*a*) to (*d*), in the press-forming by the press-forming apparatus 20A in the first stage, the upper die 40 descends and the punch 31 and the die 50 move relatively in the pressing direction. In accompaniment therewith, similarly to the first to third embodiments, the first guide face 50*c* of the preceding portion 54 (first die 52) precedes the second guide face 50*d* of the second die 53. The shapes of the first vertical wall portion 10*b* and the first flange portion 10*d* are then formed in the blank metal plate 70. In addition, the shapes of the second vertical wall portion 10*c* and the second flange portion 10*e* are partly formed in the blank metal plate 70. An intermediate product 71 is formed by such press-forming of the first stage.

As shown in FIGS. 11(*e*) to (*g*), in the press-forming by the press-forming apparatus 20B in the second stage, the upper die 40 descends and the punch 31 and die 50 move relatively in a pressing direction. In accompaniment therewith, similarly to the first to third embodiments, sliding of the first blank holder 32 and the preceding portion 54 is restricted. In addition, corresponding to descent of the second die 53, the shapes of the second vertical wall portion 10*c* and the second flange portion 10*e* are formed. The specific press-formed product 10 illustrated in the above described FIG. 3 is produced by the press-forming in which the first stage and the second stage are performed in order in this way.

In the fourth embodiment also, because forming of the first vertical wall portion 10*b* and the first flange portion 10*d* precedes forming of the second vertical wall portion 10*c* and the second flange portion 10*e*, the same advantageous effects as in the first to third embodiments are obtained.

EXAMPLES

FEM analysis as described in the following Examples 1 and 2 was performed to verify the effect of the present invention.

Example 1

In the FEM analysis of Example 1, a blank metal plate was formed into a specific press-formed product using the press-forming apparatus of the above described first embodiment. The plate thickness decrease rate, cracks and wrinkles in respective portions were evaluated with respect to the press-formed product that was obtained.

A dual-phase, high strength steel plate having a tensile strength of the 980 MPa-class and a plate thickness of 1.6 mm was adopted as the blank metal plate. The shape of the blank metal plate was set so that a portion having excess metal with a width of a maximum of around 97 mm is formed on the curved inner side of the first flange portion having a width of approximately 15 mm in the press-formed product that is obtained.

The radius of curvature of the first arc-shaped region of the top plate portion of the press-formed product was set as 80 mm. The radius of curvature of the second arc-shaped region of the top plate portion of the press-formed product was set as 36 mm. The depth d1 of the first vertical wall portion was set as 44 mm, and the depth d2 of the second vertical wall portion was set as 51 mm.

The preceding portion was arranged so that the preceding amount m was 25 mm, and the height difference n between the first guide face and the second guide face was set as 18 mm. The pressing force of the pad was set as approximately 100 kN. The pressing forces of the first blank holder and second blank holder were set in accordance with the actual length in the longitudinal direction of the first flange portion and the second flange portion, respectively, with the pressing force of the first blank holder being set to approximately 160 kN and the pressing force of the second blank holder being set to approximately 260 kN. The pressing force of the preceding portion was set to approximately 600 kN.

The preceding portion was provided across the entire area in the longitudinal direction of the first die. On the other hand, the pad was provided in the region 10*m* shown in the above described FIG. 10. A step height of 0.1 mm was provided in one part of the top face of the first blank holder, and a distance between the first blank holder and the preceding portion (first die) was maintained in a state in which the distance was greater than the plate thickness of the blank metal plate. A step height of 0.1 mm was provided in one part of the top face of the second blank holder, and a distance between the second blank holder and the second die was maintained in a state in which the distance was greater than the plate thickness of the blank metal plate.

Figure 12:
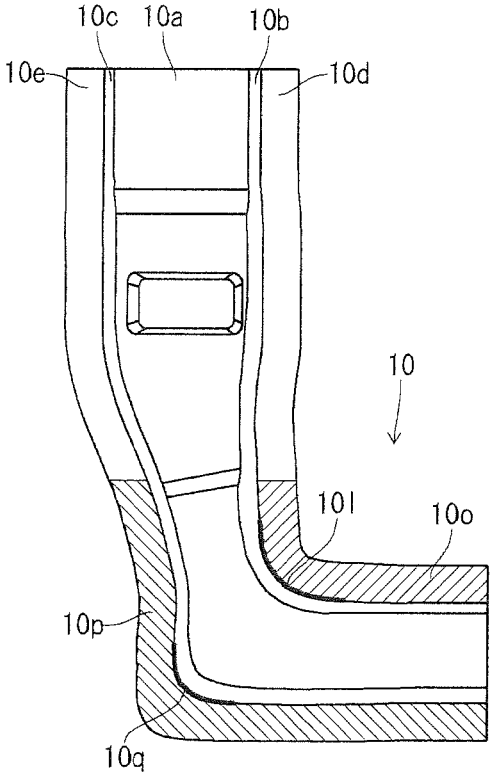
FIG. 12 is a plan view that schematically illustrates a press-formed product that is produced by press-forming of Example 1.

FIG. 12 is a plan view that schematically illustrates a press-formed product produced by press-forming according to Example 1. A region 10*o* that is indicated by a hatched portion among the entire region of the first flange portion 10*d* is a region at which the distance between the first blank holder and the preceding portion (first die) is maintained in a state in which the distance is greater than the plate thickness of the blank metal plate by means of the step height provided on the top face of the first blank holder. A region 10*p* that is indicated by a hatched portion among the entire region of the second flange portion 10*e* is a region at which the distance between the second blank holder and the second die is maintained in a state in which the distance is greater than the plate thickness of the blank metal plate by means of the step height provided on the top face of the second blank holder.

The region 10*o* of the first flange portion 10*d* is taken as a region on the curved inner side of the first arc-shaped region 10*l* of the flange portion, the entire region that is rearward in the longitudinal direction from the arc-shaped region 10*l*, and a neighboring region to the front in the longitudinal direction of the arc-shaped region 10*l*. The region 10*p* of the second flange portion 10*e* is taken as a region on the curved outer side of the second arc-shaped region 10*q* of the flange portion, the entire region that is rearward in the longitudinal direction from the arc-shaped region 10*q*, and a neighboring region to the front in the longitudinal direction of the arc-shaped region 10*q*.

Figure 13:
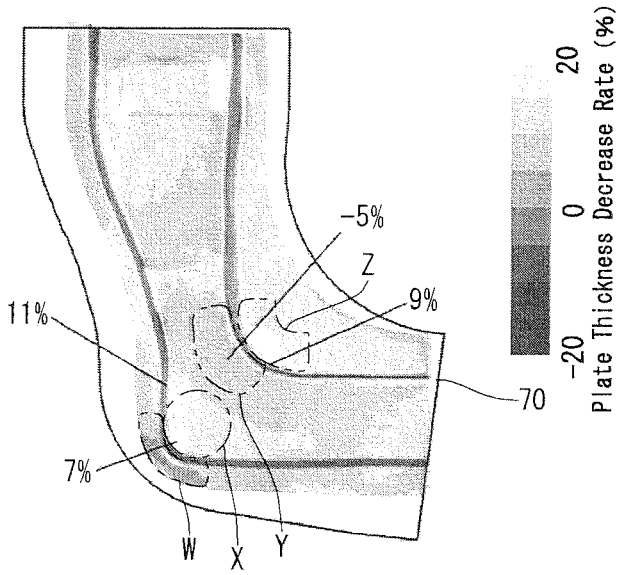
FIG. 13 is a view that illustrates the distribution of a plate thickness decrease rate when a specific press-formed product is produced by the press-forming of Example 1.

FIG. 13 is a view that illustrates the distribution of a plate thickness decrease rate when the specific press-formed product was produced by press-forming according to Example 1. In FIG. 13, the plate thickness decrease rates are indicated by degrees of shading, and the shape of the blank metal plate 70 prior to press-forming is indicated by a solid line. The plate thickness decrease rate rtb (%) was calculated by the above described Formula (1). The plate thickness decrease rate is a rate of decrease (%) in the plate thickness based on the thickness of the blank metal plate 70.

The results shown in FIG. 13 indicate the following facts. In the X region of the top plate portion, a thickness reduction was decreased, and the occurrence of cracks was suppressed. In the Y region of the top plate portion, the occurrence of wrinkles was suppressed. In the Z region of the first flange portion, the occurrence of cracks was suppressed. In the W region of the second flange portion, the occurrence of wrinkles was suppressed. The plate thickness decrease rate for the entire press-formed product was from −10 to 11%, and thus a change in the plate thickness was reduced.

Example 2

In the FEM analysis of Example 2, the specific press-formed product was formed using a similar press-forming apparatus and blank metal plate as in Example 1, and the preceding amount m of the preceding portion, that is, the stroke difference between the preceding portion and the second die was changed to various values. The plate thickness decrease rate, cracks and wrinkles in respective portions were evaluated with respect to the press-formed product that was obtained. Note that, in the press-formed product of Example 2, the depth d1 of the first vertical wall portion and the depth d2 of the second vertical wall portion were made deeper than the corresponding depth d1 and depth d2 in the press-formed product of Example 1. In other words, in the press-formed product of Example 2, the depth d1 of the first vertical wall portion was made 55 mm and the depth d2 of the second vertical wall portion was made 60 mm.

Figure 14:
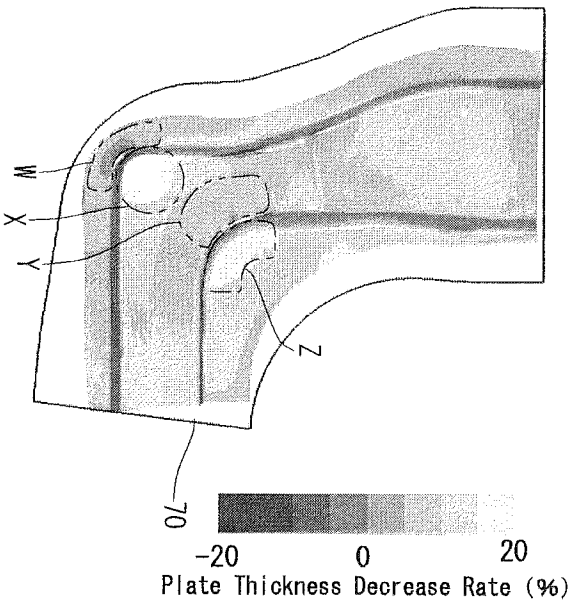
FIG. 14 is a view that illustrates an example of the distribution of a plate thickness decrease rate when a specific press-formed product is produced by press-forming of Example 2.
Figure 15:
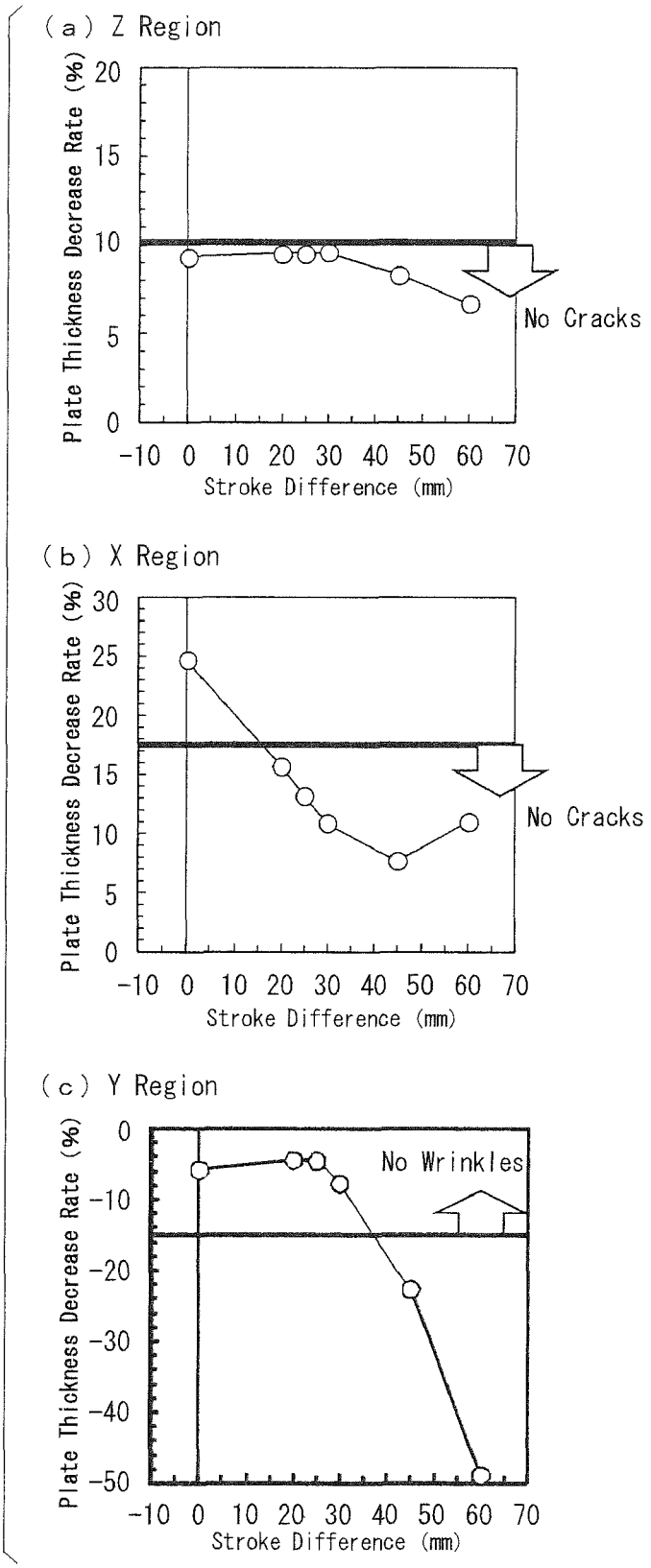
FIGS. 15(*a*) to (*c*) are views that illustrate a relation between a stroke difference between dies and a plate thickness decrease rate as results of Example 2.

FIG. 14 is a view that illustrates one example of the distribution of the plate thickness decrease rate when the specific press-formed product was produced by the press-forming of Example 2. FIGS. 15(*a*) to (*c*) are views that illustrate the relation between a stroke difference between dies and the plate thickness decrease rate as results of Example 2. Among these figures, FIG. 15(*a*) illustrates the result for the Z region of the first flange portion. FIG. 15(*b*) illustrates the result for the X region of the top plate portion. FIG. 15(*c*) illustrates the result for the Y region of the top plate portion.

The results shown in FIG. 14 and FIGS. 15(*a*) to (*c*) indicate the following facts. In a region in which the stroke difference between the preceding portion and the second die was in a range of 10 to 40 mm, cracks did not arise in the Z region and X region, and there was also no occurrence of wrinkles in the Y region. The stroke difference, that is, the preceding amount m, being 10 to 40 mm corresponds to the preceding amount ratio R (ratio which the preceding amount m occupies with respect to the depth d2 of the second vertical wall portion) being 10 to 70%. Thus, it was found that under conditions such that the preceding amount ratio R becomes 10 to 70%, cracks and wrinkles at respective portions of the press-formed product are reduced.

INDUSTRIAL APPLICABILITY

The present invention can be effectively used in the production of structural members of an automobile body.

REFERENCE SIGNS LIST

10: Press-formed product
10*a*: Top plate portion
10*b*: First vertical wall portion
10*c*: Second vertical wall portion
10*d*: First flange portion
10*e*: Second flange portion
20, 20A, 20B: Press-forming apparatus
30: Lower die
31: Punch, 31*a*: End face of punch
31*b*: First outer side face of punch

31*c*: Second outer side face of punch
32: First blank holder
33: Second blank holder
34: Cushion pin, 35: Cushion
36: First blank holder pressurizing mechanism
37: Second blank holder pressurizing mechanism
40: Upper die
41: Pad
42: Pad pressurizing mechanism
50: Die
50*a*: First inner side face of die
50*b*: Second inner side face of die
50*c*: First guide face of die
50*d*: Second guide face of die
51: Die plate
52: First die
52*a*: First die main body
53: Second die
54: Preceding portion
55: Preceding portion pressurizing mechanism
56: Stopper
70: Blank metal plate

The invention claimed is:

1. A press-forming apparatus for producing a press-formed product having an external shape that curves in an L shape along a longitudinal direction in a planar view, wherein the press-formed product comprises:

a top plate portion including an L-shaped curved region;

a first vertical wall portion that is connected to a side portion on a curved inner side among two side portions of the top plate portion;

a second vertical wall portion that is connected to a side portion on a curved outer side among the two side portions of the top plate portion;

a first flange portion that is connected to the first vertical wall portion; and a second flange portion that is connected to the second vertical wall portion, the press-forming apparatus comprising:

a punch having an end face, a first outer side face and a second outer side face that have shapes that correspond to the top plate portion, the first vertical wall portion and the second vertical wall portion, respectively;

a first blank holder that is adjacent to a curved inner side of the punch, and is slidable in a pressing direction;

a second blank holder that is adjacent to a curved outer side of the punch, and is slidable in the pressing direction;

a die that forms a pair with the punch, the first blank holder, and the second blank holder, and that has a first inner side face and a second inner side face having shapes that correspond to the first vertical wall portion and the second vertical wall portion, respectively, and has a first guide face and a second guide face that face the first blank holder and the second blank holder, respectively;

a pad that constitutes one part of the die and is slidable in the pressing direction, and among an entire region of the end face of the punch, faces at least a region that corresponds to the curved region of the top plate portion;

a preceding portion that constitutes one part of the die and is slidable in the pressing direction, and among an entire region of the first guide face and the first inner side face, includes at least a region that corresponds to the curved region of the top plate portion; and a restriction mechanism, and wherein, when pushing the punch into the die by relatively moving the punch and the die in the pressing direction to form a metal plate into the press-formed product, after the first guide face of the preceding portion precedes the second guide face of the die and the first vertical wall portion and the first flange portion are formed, sliding of the first blank holder and the preceding portion relative to the punch is restricted by the restriction mechanism, and pushing of the punch into the die is continued in the restricted state and the second vertical wall portion and the second flange portion are formed.

2. The press-forming apparatus according to claim 1, further comprising:

a cushion that slidably supports the first blank holder in the pressing direction via a cushion pin; and a stopper that limits sliding of the first blank holder, wherein, by separating the cushion pin and the first blank holder while sliding of the first blank holder is being limited by the stopper, the restriction mechanism restricts sliding of the first blank holder, and restricts sliding of the preceding portion following restriction of the first blank holder.

3. The press-forming apparatus according to claim 1, further comprising:

a pressurizing mechanism that slidably supports the first blank holder in the pressing direction;

wherein the restriction mechanism restricts the first blank holder by limiting sliding of the first blank holder, and restricts sliding of the preceding portion following restriction of the first blank holder.

4. A method for producing a press-formed product having an external shape that curves in an L shape along a longitudinal direction in a planar view, the method using a press-forming apparatus according to claim 1, the press-formed product comprising:

a top plate portion including an L-shaped curved region;

a first vertical wall portion that is connected to a side portion on a curved inner side among two side portions of the top plate portion;

a second vertical wall portion that is connected to a side portion on a curved outer side among the two side portions of the top plate portion;

a first flange portion that is connected to the first vertical, wall portion; and a second flange portion that is connected to the second vertical wall portion, wherein, when producing the press-formed product from a metal plate by press-forming, forming of the first vertical wall portion and the first flange portion is executed prior to forming of the second vertical wall portion and the second flange portion, the method including:

a holding process of, in a state in which the first guide face of the preceding portion precedes the second guide face of the die, sandwiching the metal plate by means of the first blank holder, the second blank holder and the pad, and a forming process of pushing the punch into the die by relatively moving the punch and the die in a pressing direction to form the metal plate into the press-formed product, wherein the forming process includes:

a first step of, in a state in which the first guide face of the preceding portion precedes the second guide face of the die, pushing the punch into the die to form the first vertical wall portion and the first flange, and a second step of restricting sliding of the first blank holder and the preceding portion relative to the punch by means of the restriction mechanism, and continuing pushing of the punch into the die in the restricted state to form the second vertical wall portion and the second flange portion.

* * * * *